US010004953B2

(12) United States Patent
Stites et al.

(10) Patent No.: US 10,004,953 B2
(45) **Date of Patent: *Jun. 26, 2018**

(54) GOLF CLUB HEAD OR OTHER BALL STRIKING DEVICE HAVING IMPACT-INFLUENCING BODY FEATURES

(71) Applicant: NIKE, Inc., Beaverton, OR (US)

(72) Inventors: John T. Stites, Weatherford, TX (US); Andrew G. V. Oldknow, Portland, OR (US); Robert Boyd, Flower Mound, TX (US)

(73) Assignee: NIKE, Inc., Beaverton, OR (US)

( * ) Notice: Subject to any disclaimer, the term of this patent is extended or adjusted under 35 U.S.C. 154(b) by 400 days.

This patent is subject to a terminal disclaimer.

(21) Appl. No.: 14/516,155

(22) Filed: Oct. 16, 2014

(65) Prior Publication Data

US 2015/0038261 A1 Feb. 5, 2015

Related U.S. Application Data

(63) Continuation of application No. 14/068,985, filed on Oct. 31, 2013, now Pat. No. 9,108,090, which is a (Continued)

(51) Int. Cl.

| | |
|---|---|
| ***A63B 53/04*** | (2015.01) |
| ***A63B 53/06*** | (2015.01) |
| *A63B 60/50* | (2015.01) |

(52) U.S. Cl.

CPC ..... *A63B 53/0466* (2013.01); *A63B 53/06* (2013.01); *A63B 53/047* (2013.01); (Continued)

(58) Field of Classification Search

USPC ..... 473/324–350

See application file for complete search history.

(56) References Cited

U.S. PATENT DOCUMENTS 569,438 A 10/1896 Urquhart
632,885 A * 9/1899 Sweny ..... A63B 53/0466 473/329

(Continued)

FOREIGN PATENT DOCUMENTS

CA 2139690 A1 7/1996
CN 2411030 Y 12/2000

(Continued)

OTHER PUBLICATIONS

Aug. 24, 2012—(WO) International Search Report and Written Opinion—App. PCT/US12/35476.

(Continued)

*Primary Examiner* — Alvin Hunter

(74) *Attorney, Agent, or Firm* — Banner & Witcoff, Ltd.

(57) ABSTRACT

A ball striking device, such as a golf club, includes a head with a face having an outer surface configured for striking a ball, a body connected to the face, an elongated, inwardly recessed channel located on the body and extending across a portion of the body, and an insert mounted within the channel. The insert includes a resiliently deflectable base member that engages the channel to retain the insert within the channel and a rigid outer member connected to the base member and forming at least a portion of the outer surface of the insert, where the outer member is made from a different material than the base member. Additionally, the insert has an outer surface that is substantially flush with at least one immediately adjacent surface of the body.

27 Claims, 9 Drawing Sheets

Related U.S. Application Data continuation of application No. 13/015,264, filed on Jan. 27, 2011, now Pat. No. 9,101,808.

(52) U.S. Cl.
CPC ..... *A63B 53/0487* (2013.01); *A63B 60/50* (2015.10); *A63B 2053/0433* (2013.01); *A63B 2053/0437* (2013.01); *A63B 2053/0491* (2013.01); *A63B 2209/10* (2013.01)

(56) References Cited

U.S. PATENT DOCUMENTS 648,256 A 4/1900 Hartley
777,400 A 12/1904 Clark
1,133,129 A 3/1915 Govan
1,222,770 A 4/1917 Kaye
1,705,997 A 3/1929 Williams
1,840,924 A 1/1932 Tucker
1,854,548 A 4/1932 Hunt
2,004,968 A * 6/1935 Young ..... A63B 53/04 473/343
2,087,685 A 7/1937 Hackney
2,429,351 A 10/1947 Fetterolf
2,550,846 A 5/1951 Milligan
2,750,194 A 6/1956 Clark
3,064,980 A 11/1962 Steiner
3,084,940 A * 4/1963 Cissel ..... A63B 53/04 273/DIG. 6
3,212,783 A 10/1965 Bradley
3,519,271 A 7/1970 Smith
3,606,327 A 9/1971 Gorman
3,810,631 A 5/1974 Braly
3,814,437 A 6/1974 Winquist
3,966,210 A 6/1976 Rozmus
3,970,236 A 7/1976 Rogers
3,980,301 A 9/1976 Smith
3,997,170 A 12/1976 Goldberg
4,194,739 A 3/1980 Thompson
4,313,607 A 2/1982 Thompson
4,322,083 A 3/1982 Imai
4,398,965 A * 8/1983 Campau ..... A63B 53/04 148/522
4,431,192 A 2/1984 Stuff, Jr.
4,438,931 A 3/1984 Motomiya
4,444,392 A 4/1984 Duclos
4,511,145 A 4/1985 Schmidt
4,523,759 A 6/1985 Igarashi
4,534,558 A 8/1985 Yoneyama
4,535,990 A 8/1985 Yamada
4,582,321 A 4/1986 Yoneyama
4,630,827 A 12/1986 Yoneyama
4,664,383 A 5/1987 Aizawa
4,667,963 A 5/1987 Yoneyama
4,681,321 A 7/1987 Chen et al.
4,697,814 A 10/1987 Yamada
4,708,347 A 11/1987 Kobayashi
4,728,105 A 3/1988 Kobayashi
4,732,389 A 3/1988 Kobayashi
4,811,949 A 3/1989 Kobayashi
4,811,950 A 3/1989 Kobayashi
4,842,280 A 6/1989 Hilton
4,867,458 A 9/1989 Sumikawa et al.
4,871,174 A 10/1989 Kobayashi
4,895,371 A 1/1990 Bushner
4,898,387 A 2/1990 Finney
4,927,144 A 5/1990 Stormon
4,928,972 A 5/1990 Nakanishi et al.
4,930,781 A 6/1990 Allen
5,004,242 A 4/1991 Iwanaga et al.
5,009,425 A 4/1991 Okumoto et al.
D318,703 S 7/1991 Shearer
5,028,049 A 7/1991 McKeighen
5,060,951 A 10/1991 Allen
5,067,715 A 11/1991 Schmidt et al.
5,076,585 A 12/1991 Bouquet
5,078,397 A 1/1992 Aizawa
5,080,366 A 1/1992 Okumoto et al.
D326,130 S 5/1992 Chorne
5,186,465 A 2/1993 Chorne
5,205,560 A 4/1993 Hoshi et al.
5,211,401 A 5/1993 Hainey
5,213,328 A 5/1993 Long et al.
5,228,694 A 7/1993 Okumoto et al.
5,269,517 A 12/1993 Petruccelli et al.
5,282,625 A 2/1994 Schmidt et al.
5,290,036 A 3/1994 Fenton et al.
5,295,689 A 3/1994 Lundberg
5,301,941 A 4/1994 Allen
5,301,946 A 4/1994 Schmidt et al.
5,316,305 A * 5/1994 McCabe ..... A63B 53/04 473/332
5,326,106 A 7/1994 Meyer
5,330,187 A 7/1994 Schmidt et al.
D350,176 S 8/1994 Antonious
5,333,871 A 8/1994 Wishon
5,340,104 A 8/1994 Griffin
5,346,219 A * 9/1994 Pehoski ..... A63B 53/0487 473/325
5,377,985 A 1/1995 Ohnishi
5,380,010 A 1/1995 Werner et al.
5,407,196 A 4/1995 Busnardo
5,419,556 A 5/1995 Take
5,419,560 A 5/1995 Bamber
5,435,551 A 7/1995 Chen
5,437,456 A * 8/1995 Schmidt ..... A63B 53/04 473/290
5,447,307 A 9/1995 Antonious
5,451,056 A 9/1995 Manning
5,451,058 A 9/1995 Price et al.
5,464,211 A 11/1995 Atkins, Sr.
5,472,201 A 12/1995 Aizawa et al.
5,472,203 A 12/1995 Schmidt et al.
5,480,152 A 1/1996 Schmidt et al.
5,489,097 A 2/1996 Simmons
5,492,327 A * 2/1996 Biafore, Jr. ..... A63B 53/04 473/332
5,505,453 A 4/1996 Mack
5,518,243 A 5/1996 Redman
5,531,439 A * 7/1996 Azzarella ..... A63B 53/0487 473/331
5,533,725 A 7/1996 Reynolds, Jr.
5,533,728 A 7/1996 Pehoski et al.
5,547,427 A 8/1996 Rigal et al.
5,564,705 A 10/1996 Kobayashi et al.
5,570,886 A 11/1996 Rigal et al.
5,586,947 A * 12/1996 Hutin ..... A63B 53/04 473/324
5,586,948 A 12/1996 Mick
5,595,552 A 1/1997 Wright et al.
5,601,498 A 2/1997 Antonious
5,603,668 A 2/1997 Antonious
5,607,365 A 3/1997 Wolf
5,616,088 A * 4/1997 Aizawa ..... A63B 53/04 473/341
5,626,530 A 5/1997 Schmidt et al.
D381,382 S 7/1997 Fenton, Jr.
5,669,829 A 9/1997 Lin
D386,550 S 11/1997 Wright et al.
D386,551 S 11/1997 Solheim et al.
D387,113 S 12/1997 Burrows
D387,405 S 12/1997 Solheim et al.
5,692,972 A 12/1997 Langslet
5,695,409 A 12/1997 Jackson
5,709,615 A 1/1998 Liang
5,711,722 A 1/1998 Miyajima et al.
5,735,754 A 4/1998 Antonious
5,746,664 A 5/1998 Reynolds, Jr.
5,749,795 A * 5/1998 Schmidt ..... A63B 53/04 473/329
5,766,094 A 6/1998 Mahaffey et al.
5,772,525 A 6/1998 Klein
5,785,609 A 7/1998 Sheets et al.

(56) References Cited

U.S. PATENT DOCUMENTS 5,788,584 A 8/1998 Parente et al.
D398,687 S 9/1998 Miyajima et al.
5,803,830 A 9/1998 Austin et al.
D399,274 S 10/1998 Bradford
5,820,481 A 10/1998 Raudman
D400,945 S 11/1998 Gilbert et al.
5,839,975 A 11/1998 Lundberg
5,863,261 A 1/1999 Eggiman
5,873,791 A 2/1999 Allen
5,888,148 A 3/1999 Allen
5,908,356 A 6/1999 Nagamoto
5,908,357 A 6/1999 Hsieh
5,941,782 A 8/1999 Cook
5,947,841 A 9/1999 Silvestro
5,971,868 A 10/1999 Kosmatka
5,997,415 A 12/1999 Wood
6,001,030 A 12/1999 Delaney
6,007,432 A 12/1999 Kosmatka
6,015,354 A 1/2000 Ahn et al.
D422,041 S 3/2000 Bradford
6,042,486 A 3/2000 Gallagher
6,048,278 A 4/2000 Meyer et al.
6,074,309 A 6/2000 Mahaffey
6,080,068 A 6/2000 Takeda
6,086,485 A 7/2000 Hamada et al.
6,089,994 A * 7/2000 Sun ..... A63B 53/04 473/338
6,095,931 A 8/2000 Hettinger et al.
6,117,022 A 9/2000 Crawford et al.
6,149,534 A 11/2000 Peters et al.
6,159,109 A 12/2000 Langslet
6,176,791 B1 1/2001 Wright
6,193,614 B1 2/2001 Sasamoto et al.
6,203,449 B1 3/2001 Kenmi
6,217,461 B1 4/2001 Galy
6,270,423 B1 8/2001 Webb
6,299,546 B1 10/2001 Wang
6,302,807 B1 10/2001 Rohrer
6,319,149 B1 11/2001 Lee
6,332,848 B1 12/2001 Long et al.
6,338,683 B1 1/2002 Kosmatka
6,342,018 B1 1/2002 Mason
6,344,000 B1 2/2002 Hamada et al.
6,344,001 B1 * 2/2002 Hamada ..... A63B 53/04 473/329
6,348,013 B1 2/2002 Kosmatka
6,354,956 B1 3/2002 Doong
6,354,961 B1 3/2002 Allen
RE37,647 E 4/2002 Wolf
6,368,234 B1 4/2002 Galloway
6,386,987 B1 5/2002 Lejeune, Jr.
6,402,637 B1 6/2002 Sasamoto et al.
6,402,638 B1 6/2002 Kelley
6,422,951 B1 7/2002 Burrows
6,428,423 B1 8/2002 Merko
6,435,982 B1 8/2002 Galloway et al.
6,443,857 B1 9/2002 Chuang
6,447,405 B1 9/2002 Chen
6,454,665 B2 9/2002 Antonious
6,471,603 B1 10/2002 Kosmatka
6,478,690 B2 11/2002 Helmstetter et al.
6,482,107 B1 11/2002 Urbanski et al.
6,506,129 B2 1/2003 Chen
6,524,197 B2 2/2003 Boone
6,524,198 B2 2/2003 Takeda
6,533,679 B1 3/2003 McCabe et al.
6,551,199 B2 4/2003 Viera
6,558,271 B1 5/2003 Beach et al.
6,602,149 B1 8/2003 Jacobson
6,605,007 B1 8/2003 Bissonnette et al.
6,607,451 B2 8/2003 Kosmatka et al.
6,616,547 B2 * 9/2003 Vincent ..... A63B 53/047 473/334
6,641,490 B2 11/2003 Ellemor
6,652,390 B2 11/2003 Bradford
6,652,391 B1 11/2003 Kubica et al.
6,688,989 B2 * 2/2004 Best ..... A63B 53/04 473/332
6,695,715 B1 2/2004 Chikaraishi
6,719,641 B2 * 4/2004 Dabbs ..... A63B 53/04 473/291
6,719,645 B2 4/2004 Kouno
6,739,983 B2 5/2004 Helmstetter et al.
6,743,112 B2 6/2004 Nelson
6,773,360 B2 8/2004 Willett et al.
6,780,123 B2 8/2004 Hasebe
6,800,037 B2 10/2004 Kosmatka
6,800,038 B2 10/2004 Willett et al.
6,800,039 B1 10/2004 Tseng
6,811,496 B2 11/2004 Wahl et al.
6,840,872 B2 1/2005 Yoneyama
D502,232 S 2/2005 Antonious
6,863,620 B2 3/2005 Tucker, Sr.
6,887,165 B2 5/2005 Tsurumaki
6,899,638 B2 5/2005 Iwata et al.
6,923,733 B2 8/2005 Chen
6,926,618 B2 8/2005 Sanchez et al.
6,960,142 B2 11/2005 Bissonnette et al.
6,991,560 B2 * 1/2006 Tseng ..... A63B 53/0466 473/332
D515,642 S 2/2006 Antonious
6,994,635 B2 2/2006 Poynor
7,018,303 B2 3/2006 Yamamoto
7,018,304 B2 3/2006 Bradford
7,025,692 B2 4/2006 Erickson et al.
7,041,003 B2 5/2006 Bissonnette et al.
7,048,646 B2 5/2006 Yamanaka et al.
D523,498 S 6/2006 Chen et al.
7,056,229 B2 6/2006 Chen
7,066,835 B2 6/2006 Evans et al.
7,070,513 B2 7/2006 Takeda et al.
7,070,515 B1 7/2006 Liu
7,083,530 B2 * 8/2006 Wahl ..... A63B 53/047 337/338
7,086,964 B2 * 8/2006 Chen ..... A63B 53/047 473/324
7,090,590 B2 8/2006 Chen
7,121,956 B2 10/2006 Lo
7,128,660 B2 10/2006 Gillig
7,128,663 B2 10/2006 Bamber
7,134,971 B2 * 11/2006 Franklin ..... A63B 53/04 473/332
7,137,907 B2 11/2006 Gibbs et al.
7,140,975 B2 11/2006 Bissonnette et al.
7,140,976 B2 * 11/2006 Chen ..... A63B 53/047 473/334
7,140,977 B2 11/2006 Atkins, Sr.
7,156,750 B2 1/2007 Nishitani et al.
7,163,468 B2 1/2007 Gibbs et al.
7,163,470 B2 1/2007 Galloway et al.
7,169,059 B2 1/2007 Rice et al.
7,175,541 B2 2/2007 Lo
7,186,185 B2 3/2007 Nagy
7,186,188 B2 * 3/2007 Gilbert ..... A63B 53/047 473/290
7,192,364 B2 3/2007 Long
7,201,668 B1 4/2007 Pamias
7,207,898 B2 4/2007 Rice et al.
7,211,006 B2 5/2007 Chang
7,226,366 B2 * 6/2007 Galloway ..... A63B 53/0466 473/332
7,241,230 B2 7/2007 Tsunoda
7,244,189 B1 7/2007 Stobbe
7,247,104 B2 7/2007 Poynor
7,258,631 B2 8/2007 Galloway et al.
7,261,643 B2 8/2007 Rice et al.
D551,310 S 9/2007 Kuan et al.
D552,701 S 10/2007 Ruggiero et al.
7,278,926 B2 10/2007 Frame
7,294,064 B2 11/2007 Tsurumaki et al.
7,297,071 B2 11/2007 Hyman
7,297,073 B2 11/2007 Jung
7,335,112 B1 2/2008 Bitondo

(56) References Cited

U.S. PATENT DOCUMENTS 7,351,161 B2 4/2008 Beach
7,367,898 B2 5/2008 Hawkins et al.
7,387,579 B2 6/2008 Lin et al.
7,396,289 B2 7/2008 Soracco et al.
7,396,293 B2 * 7/2008 Soracco ..... A63B 53/0466 473/329
7,396,296 B2 7/2008 Evans
7,407,443 B2 8/2008 Franklin et al.
7,431,663 B2 10/2008 Pamias
7,435,189 B2 10/2008 Hirano
7,442,132 B2 10/2008 Nishio
7,445,563 B1 11/2008 Werner
7,470,201 B2 12/2008 Nakahara et al.
7,473,186 B2 1/2009 Best et al.
7,476,161 B2 1/2009 Williams et al.
7,494,426 B2 2/2009 Nishio et al.
7,500,924 B2 * 3/2009 Yokota ..... A63B 53/0466 473/332
7,520,820 B2 4/2009 Dimarco
7,530,901 B2 5/2009 Imamoto et al.
7,540,810 B2 6/2009 Hettinger et al.
7,559,850 B2 * 7/2009 Gilbert ..... A63B 53/047 473/290
7,563,176 B2 * 7/2009 Roberts ..... A63B 53/047 473/329
7,572,193 B2 8/2009 Yokota
7,575,523 B2 8/2009 Yokota
7,575,524 B2 8/2009 Willett et al.
7,582,024 B2 * 9/2009 Shear ..... A63B 53/0466 473/329
7,618,331 B2 11/2009 Hirano
7,621,820 B2 11/2009 Clausen et al.
7,632,193 B2 12/2009 Thielen
7,641,569 B2 1/2010 Best et al.
7,651,409 B1 1/2010 Mier
7,717,803 B2 5/2010 DiMarco
7,717,807 B2 5/2010 Evans et al.
7,722,478 B2 5/2010 Ebner
D619,666 S 7/2010 DePaul
7,749,101 B2 * 7/2010 Imamoto ..... A63B 53/0466 473/332
7,753,809 B2 7/2010 Cackett et al.
7,758,452 B2 7/2010 Soracco
7,803,066 B2 9/2010 Solheim et al.
7,824,277 B2 11/2010 Bennett et al.
7,846,036 B2 12/2010 Tanaka
7,857,711 B2 12/2010 Shear
7,867,105 B2 1/2011 Moon
7,871,336 B2 1/2011 Breier et al.
7,878,924 B2 2/2011 Clausen et al.
7,896,753 B2 * 3/2011 Boyd ..... A63B 53/0466 473/226
7,922,596 B2 4/2011 Vanderbilt et al.
7,922,603 B2 4/2011 Boyd et al.
7,927,231 B2 4/2011 Sato et al.
7,931,545 B2 4/2011 Soracco et al.
7,934,998 B2 5/2011 Yokota
7,935,003 B2 5/2011 Matsunaga et al.
7,938,739 B2 5/2011 Cole et al.
7,959,523 B2 6/2011 Rae et al.
7,967,699 B2 6/2011 Soracco
7,988,565 B2 8/2011 Abe
7,997,999 B2 8/2011 Roach et al.
8,007,371 B2 8/2011 Breier et al.
8,012,041 B2 9/2011 Gibbs et al.
8,016,694 B2 * 9/2011 Llewellyn ..... A63B 53/0466 473/334
8,043,166 B2 10/2011 Cackett et al.
8,070,622 B2 12/2011 Schmidt
8,172,697 B2 5/2012 Cackett et al.
8,177,664 B2 5/2012 Horii et al.
8,182,364 B2 5/2012 Cole et al.
8,187,116 B2 5/2012 Boyd et al.
8,206,241 B2 * 6/2012 Boyd ..... A63B 53/0466 473/332
8,235,841 B2 8/2012 Stites et al.
8,235,844 B2 8/2012 Albertsen et al.
8,241,143 B2 8/2012 Albertsen et al.
8,241,144 B2 * 8/2012 Albertsen ..... A63B 53/0466 473/345
8,251,834 B2 8/2012 Curtis et al.
8,251,836 B2 8/2012 Brandt
8,257,195 B1 9/2012 Erickson
8,257,196 B1 9/2012 Abbott et al.
8,277,337 B2 10/2012 Shimazaki
8,303,434 B1 11/2012 DePaul
8,308,583 B2 11/2012 Morris et al.
8,328,659 B2 * 12/2012 Shear ..... A63B 53/0466 473/329
8,337,325 B2 * 12/2012 Boyd ..... A63B 53/047 473/332
8,353,786 B2 1/2013 Beach et al.
8,382,604 B2 2/2013 Billings
D678,913 S 3/2013 Chu
8,403,771 B1 3/2013 Rice et al.
8,430,763 B2 4/2013 Beach et al.
8,430,764 B2 4/2013 Bennett et al.
8,435,134 B2 5/2013 Tang et al.
8,435,135 B2 5/2013 Stites et al.
8,491,416 B1 7/2013 Demille et al.
8,517,855 B2 8/2013 Beach et al.
8,517,860 B2 8/2013 Albertsen et al.
8,562,453 B2 10/2013 Sato
8,579,728 B2 11/2013 Morales et al.
8,591,351 B2 11/2013 Albertsen et al.
8,591,352 B2 11/2013 Hirano
8,591,353 B1 11/2013 Honea et al.
D697,152 S 1/2014 Harbert et al.
8,628,433 B2 1/2014 Stites et al.
8,632,419 B2 1/2014 Tang et al.
8,641,555 B2 2/2014 Stites et al.
8,663,027 B2 3/2014 Morales et al.
8,690,704 B2 4/2014 Thomas
8,696,491 B1 4/2014 Myers
8,702,531 B2 4/2014 Boyd et al.
8,734,265 B2 5/2014 Soracco
D707,768 S 6/2014 Oldknow et al.
D707,769 S 6/2014 Oldknow et al.
D708,281 S 7/2014 Oldknow et al.
D709,575 S 7/2014 Oldknow et al.
8,827,831 B2 9/2014 Burnett et al.
8,827,836 B2 9/2014 Thomas
8,834,289 B2 9/2014 de la Cruz et al.
8,834,290 B2 * 9/2014 Bezilla ..... A63B 53/0466 473/329
9,011,267 B2 * 4/2015 Burnett ..... A63B 53/04 473/329
9,089,749 B2 * 7/2015 Burnett ..... A63B 53/0466
9,101,808 B2 * 8/2015 Stites ..... A63B 53/0466
9,108,090 B2 8/2015 Stites et al.
2002/0019265 A1 2/2002 Allen
2002/0137576 A1 9/2002 Dammen
2002/0183134 A1 12/2002 Allen et al.
2002/0189356 A1 12/2002 Bissonnette et al.
2003/0013545 A1 1/2003 Vincent et al.
2003/0054900 A1 3/2003 Tindale
2003/0190975 A1 10/2003 Fagot
2003/0220154 A1 11/2003 Anelli
2004/0009829 A1 1/2004 Kapilow
2004/0018890 A1 1/2004 Stites et al.
2004/0023729 A1 2/2004 Nagai et al.
2004/0121852 A1 6/2004 Tsurumaki
2004/0180730 A1 9/2004 Franklin et al.
2004/0192463 A1 * 9/2004 Tsurumaki ..... A63B 53/0466 473/329
2004/0219991 A1 11/2004 Suprock et al.
2005/0009630 A1 1/2005 Chao et al.
2005/0032586 A1 2/2005 Willett et al.
2005/0049075 A1 3/2005 Chen et al.
2005/0070371 A1 3/2005 Chen et al.
2005/0096151 A1 5/2005 Hou et al.
2005/0101407 A1 5/2005 Hirano

(56) References Cited

U.S. PATENT DOCUMENTS

2005/0119068 A1 6/2005 Onoda et al.
2005/0119070 A1* 6/2005 Kumamoto ..... A63B 53/0466 473/345
2005/0124435 A1 6/2005 Gambetta et al.
2005/0192118 A1 9/2005 Rice et al.
2005/0215350 A1 9/2005 Reyes et al.
2005/0227781 A1 10/2005 Huang et al.
2005/0266933 A1 12/2005 Galloway
2006/0000528 A1 1/2006 Galloway
2006/0019770 A1 1/2006 Meyer et al.
2006/0040765 A1 2/2006 Sano
2006/0046868 A1 3/2006 Murphy
2006/0068932 A1 3/2006 Rice et al.
2006/0073908 A1 4/2006 Tavares et al.
2006/0073910 A1 4/2006 Imamoto et al.
2006/0079349 A1 4/2006 Rae et al.
2006/0094531 A1 5/2006 Bissonnette et al.
2006/0111201 A1 5/2006 Nishio et al.
2006/0122004 A1 6/2006 Chen et al.
2006/0194644 A1 8/2006 Nishio
2006/0281582 A1 12/2006 Sugimoto
2007/0015601 A1 1/2007 Tsunoda et al.
2007/0021234 A1 1/2007 Tsurumaki et al.
2007/0026961 A1* 2/2007 Hou ..... A63B 53/0466 473/329
2007/0049400 A1* 3/2007 Imamoto ..... A63B 53/0466 473/329
2007/0049407 A1 3/2007 Tateno et al.
2007/0049417 A1 3/2007 Shear
2007/0117648 A1 5/2007 Yokota
2007/0155538 A1 7/2007 Rice et al.
2007/0225085 A1 9/2007 Koide et al.
2007/0238551 A1 10/2007 Yokota
2008/0015047 A1 1/2008 Rice et al.
2008/0032817 A1 2/2008 Lo
2008/0039228 A1 2/2008 Breier et al.
2008/0064523 A1 3/2008 Chen
2008/0125239 A1 5/2008 Clausen et al.
2008/0125244 A1 5/2008 Meyer et al.
2008/0125246 A1 5/2008 Matsunaga
2008/0139339 A1 6/2008 Cheng
2008/0146370 A1 6/2008 Beach et al.
2008/0182682 A1 7/2008 Rice et al.
2008/0248896 A1 10/2008 Hirano
2009/0062032 A1* 3/2009 Boyd ..... A63B 53/047 473/338
2009/0075751 A1 3/2009 Gilbert et al.
2009/0098949 A1 4/2009 Chen
2009/0163294 A1 6/2009 Cackett et al.
2009/0264214 A1 10/2009 De La Cruz et al.
2009/0286611 A1 11/2009 Beach et al.
2009/0318245 A1 12/2009 Yim et al.
2010/0016095 A1 1/2010 Burnett et al.
2010/0029402 A1 2/2010 Noble et al.
2010/0035701 A1 2/2010 Kusumoto
2010/0056298 A1 3/2010 Jertson et al.
2010/0069171 A1 3/2010 Clausen et al.
2010/0093463 A1 4/2010 Davenport et al.
2010/0113183 A1 5/2010 Soracco
2010/0113184 A1 5/2010 Kuan et al.
2010/0190573 A1 7/2010 Boyd
2010/0197423 A1 8/2010 Thomas et al.
2010/0197426 A1 8/2010 De La Cruz et al.
2010/0234127 A1 9/2010 Snyder et al.
2010/0261546 A1 10/2010 Nicodem
2010/0273569 A1 10/2010 Soracco
2010/0292024 A1 11/2010 Hagood et al.
2010/0304887 A1 12/2010 Bennett et al.
2011/0021284 A1 1/2011 Stites et al.
2011/0098127 A1 4/2011 Yamamoto
2011/0098128 A1 4/2011 Clausen et al.
2011/0118051 A1 5/2011 Thomas
2011/0152001 A1 6/2011 Hirano
2011/0195798 A1 8/2011 Sander et al.
2011/0218053 A1 9/2011 Tang et al.
2011/0256951 A1 10/2011 Soracco et al.
2011/0256954 A1 10/2011 Soracco
2011/0294599 A1 12/2011 Albertsen et al.
2012/0077615 A1 3/2012 Schmidt
2012/0083362 A1 4/2012 Albertsen et al.
2012/0083363 A1 4/2012 Albertsen et al.
2012/0122601 A1 5/2012 Beach et al.
2012/0142447 A1 6/2012 Boyd et al.
2012/0142452 A1 6/2012 Burnett et al.
2012/0184393 A1 7/2012 Franklin
2012/0196701 A1 8/2012 Stites et al.
2012/0202615 A1 8/2012 Beach et al.
2013/0065705 A1 3/2013 Morales et al.
2013/0102410 A1 4/2013 Stites et al.
2014/0080629 A1 3/2014 Sargent et al.

FOREIGN PATENT DOCUMENTS

CN 1984698 A 6/2007
EP 2377586 A2 10/2011
FR 2672226 A1 8/1992
FR 2717701 A1 * 9/1995 ..... A63B 53/04
FR 2717702 A1 * 9/1995 ..... A63B 53/04
GB 2280380 A 2/1995
GB 2388792 A 11/2003
JP H05317465 A 12/1993
JP H06114127 A 4/1994
JP H0639036 U 5/1994
JP H07255886 A 10/1995
JP H07275407 A 10/1995
JP H07284546 A 10/1995
JP H08000785 1/1996
JP H08131599 A 5/1996
JP H08141117 A 6/1996
JP H0947528 A 2/1997
JP H09276455 A 10/1997
JP H10305119 A 11/1998
JP H1157082 A 3/1999
JP H11169493 A 6/1999
JP H11244431 A 9/1999
JP 2980002 B2 11/1999
JP 11299938 11/1999
JP 2000126340 A 5/2000
JP 11114102 6/2000
JP 2000176056 A 6/2000
JP 2000197718 7/2000
JP 2000271253 A 10/2000
JP 2001054596 A 2/2001
JP 2001058015 3/2001
JP 2001062004 3/2001
JP 2001137396 5/2001
JP 2001145712 5/2001
JP 2001293113 A 10/2001
JP 2002017908 A 1/2002
JP 2002017912 A 1/2002
JP 2002052099 A * 2/2002
JP 2002165905 A 6/2002
JP 2002177416 A 6/2002
JP 2002239040 A 8/2002
JP 2002248183 A 9/2002
JP 2002306646 10/2002
JP 2002306647 A 10/2002
JP 2003000774 1/2003
JP 2003079769 3/2003
JP 2003093554 A 4/2003
JP 2003210627 7/2003
JP 2004216131 A * 8/2004
JP 2004313762 11/2004
JP 2004329544 11/2004
JP 2004351054 A * 12/2004
JP 2005013529 A 1/2005
JP 2005131280 A 5/2005
JP 2005193069 7/2005
JP 2005253973 A 9/2005
JP 2005305178 A 11/2005
JP 2006000435 A 1/2006
JP 2006020817 A 1/2006
JP 2006198251 A 8/2006
JP 2006223701 A 8/2006

(56) References Cited

FOREIGN PATENT DOCUMENTS

| | | | | |
|---|---|---|---|---|
| JP | 2007209722 | A | | 8/2007 |
| JP | 2007530151 | A | | 11/2007 |
| JP | 2008036315 | A | | 2/2008 |
| JP | 2008237689 | A | | 10/2008 |
| JP | 2008289866 | A | | 12/2008 |
| JP | 2009201744 | A | | 9/2009 |
| JP | 2009534546 | A | | 9/2009 |
| JP | 2010148652 | A | | 7/2010 |
| JP | 2010148653 | A | | 7/2010 |
| JP | 2010154875 | | | 7/2010 |
| JP | 2010154887 | A | | 7/2010 |
| JP | 2010279847 | A | * | 12/2010 |
| JP | 2011024999 | A | * | 2/2011 |
| WO | 9920358 | A1 | | 4/1999 |
| WO | 0149376 | A1 | | 7/2001 |
| WO | 200505842 | A1 | | 1/2005 |
| WO | 2006073930 | A2 | | 7/2006 |
| WO | 2007123970 | A2 | | 11/2007 |
| WO | 2008157691 | A2 | | 12/2008 |
| WO | 2009035345 | A1 | | 3/2009 |

OTHER PUBLICATIONS

Aug. 8, 2013—(WO) International Preliminary Report on Patentability App. No. PCT/US2012/022027.
May 30, 2012—(WO) International Search Report and Written Opinion App. No. PCT/US2012/022027.
Nov. 26, 2010—(WO) International Search Report and Written Opinion App. No. PCT/US2010/043073.
Dec. 18, 2012—(WO) International Search Report and Written Opinion App. No. PCT/US2012/057490.
"Photographs 1, 2 and 3", presented in U.S. Appl. No. 12/842,650, of unknown source, taken after the filing date of U.S. Appl. No. 12/842,650, depicting a golf club product; presented to the Patent Office for consideration on Oct. 7, 2011.
Nov. 5, 2010—(WO) International Search Report & Written Opinion, App. No. PCT/US2009/064164.
Mar. 20, 2014—(WO) International Search Report and Written Opinion App. No. PCT/US2013/043641.
Nov. 6, 2013—(WO) Partial Search Report, App.No. PCT/US2013/043641.
Jan. 7, 2010—(WO) International Preliminary Report on Patentability App. PCT/US2008/067499.
May 19, 2009—(WO) International Search Report and Written Opinion App. No. PCT/US2008/067499.
Feb. 27, 2013—(WO) International Search Report and Written Opinion—App. PCT/US2012/067050.
Apr. 12, 2010—(WO) Partial Search Report App. No. PCT/US2010/021355.
Sep. 9, 2011—(WO) International Search Report and Written Opinion, App. No. PCT/US2011/023678.
Sep. 10, 2012—(WO) International Search Report App No. PCT/US2012/03542.
Jul. 31, 2013—(WO) International Search Report and Written Opinion—App. No. PCT/US2013/043700.
Aug. 2, 2013—(WO) International Search Report and Written Opinion—App. PCT/US2013/043656.
Jul. 7, 2010—(WO) International Search Report and Written Opinion, App. PCT/US2010/021355.
Nov. 30, 2012—(WO) International Search Report and Written Opinion App. PCT/US2012/052107.
May 6, 2011—(WO) International Search Report and Written Opinion—App. PCT/US2011/023968.

* cited by examiner

FIG. 11
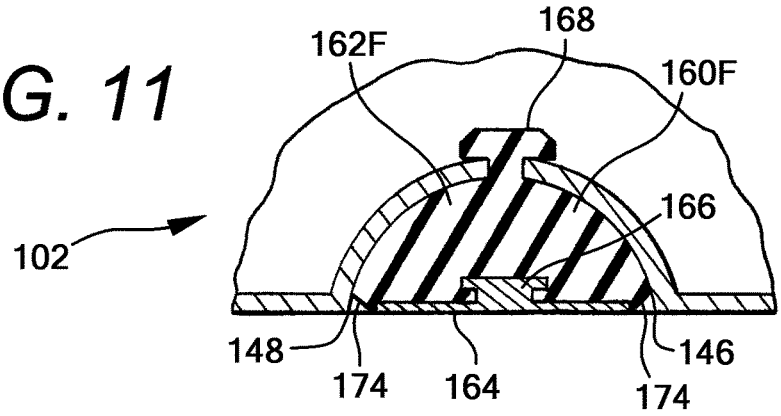
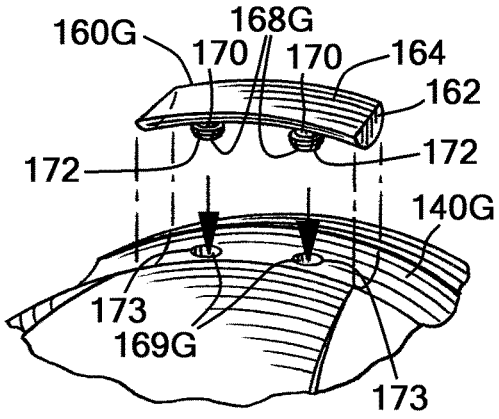
FIG. 12
FIG. 13
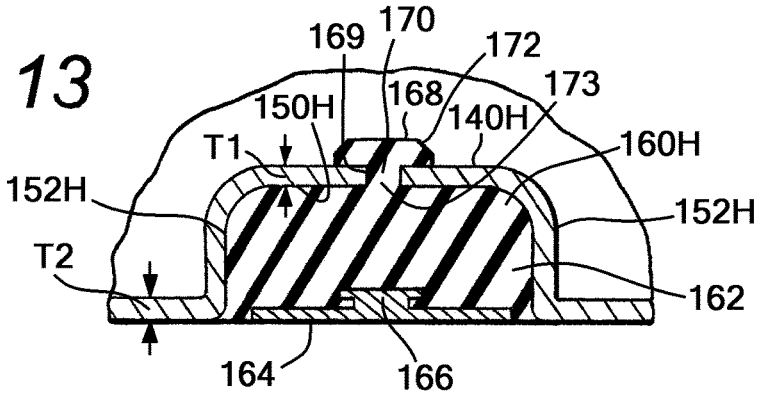

GOLF CLUB HEAD OR OTHER BALL STRIKING DEVICE HAVING IMPACT-INFLUENCING BODY FEATURES

CROSS REFERENCE TO RELATED APPLICATIONS

This application is a continuation of co-pending U.S. patent application Ser. No. 14/068,985, filed Oct. 31, 2013, which is a continuation of co-pending U.S. patent application Ser. No. 13/015,264, filed Jan. 27, 2011, and this application claims priority to and the benefit of both of such applications, which are incorporated by reference herein in their entireties.

TECHNICAL FIELD

The invention relates generally to ball striking devices, such as golf club heads, having one or more body features that influence the impact of a ball on a ball-striking face of the device. Certain aspects of this invention relate to golf club heads having a compression channel located on the body of the head, with an insert connected to the head and positioned within the channel.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club should meet the golf ball square (or substantially square) to the desired target path. Moreover, the golf club should meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Accordingly, club head features that can help a user keep the club face square with the ball would tend to help the ball fly straighter and truer, in the desired direction, and often with improved and/or reliable distance.

Various golf club heads have been designed to improve a golfer's accuracy by assisting the golfer in squaring the club head face at impact with a golf ball. When the club face is not square at the point of engagement, the golf ball may fly in an unintended direction and/or may follow a route that curves left or right, ball flights that are often referred to as "pulls," "pushes," "draws," "fades," "hooks," or "slices," or may exhibit more boring or climbing trajectories. The distance and direction of ball flight can also be significantly affected by the spin imparted to the ball by the impact with the club head. Additionally, the spin of the ball can change the behavior of the ball as it rolls and bounces after impact with the ground. Various speeds and directions of spin on the ball can be a product of many factors, including the point of impact, the direction of the club head upon impact, the degree of twisting of the club head upon impact, and the location of the center of gravity of the club head.

The energy or velocity transferred to the ball by a golf club also may be related, at least in part, to the flexibility of the club face at the point of contact, and can be expressed using a measurement called "coefficient of restitution" (or "COR"). The maximum COR for golf club heads is currently limited by the USGA at 0.83. Generally, a club head will have an area of highest response relative to other areas of the face, such as having the highest COR, which imparts the greatest energy and velocity to the ball, and this area is typically positioned at or near the center of the face. In one example, the area of highest response may have a COR that is equal to the prevailing USGA limit (e.g. currently 0.83). However, because golf clubs are typically designed to contact the ball at or around the center of the face, off-center hits may result in less energy being transferred to the ball, decreasing the distance of the shot.

The flexing behavior of the ball striking face and/or other portions of the head during impact can also influence the energy and velocity transferred to the ball, the direction of ball flight after impact, and the spin imparted to the ball, among other factors. Accordingly, a need exists to alter and/or improve the deformation of the ball striking face and/or other portions of the head during impact. The flexing behavior of the ball itself during impact can also influence some or all of these factors. Certain characteristics of the face and/or other portions of the head during impact can also have an effect on the deformation of the ball. Accordingly, a need also exists to provide a ball striking head with features that cause altered and/or improved deformation behavior of the ball during impacts with the ball striking face of the head.

The interaction between the club head and the playing surface can also affect the distance and accuracy of a golf shot, particularly with clubs such as fairway woods, hybrid clubs, irons, and putters, which are designed for hitting a ball resting directly on the playing surface. Drag created by friction between the sole of the club head and the playing surface can reduce the speed of the swing and the resultant velocity and distance of the shot. Additionally, forces between the club head and the playing surface can twist or otherwise alter the direction or orientation of the club head during the swing, which can also reduce distance and velocity, as well as accuracy. Accordingly, a need also exists to provide a ball striking head with features that reduce drag and other forces between the club head and the playing surface during a swing.

The present devices and methods are provided to address at least some of the problems discussed above and other problems, and to provide advantages and aspects not provided by prior ball striking devices of this type. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft thereto. Various example structures of heads described herein include a face having a ball striking surface configured for striking a ball, a body connected to the face, an elongated, inwardly recessed channel located on the body and extending across a portion of the body, and an insert mounted within the channel. In one example structure, the insert includes a resiliently deflectable base member, and the insert engages the channel to retain the insert within the channel. In another example structure, the insert includes a base member that engages the channel to retain the insert within the channel and a rigid outer member connected to the base member and forming at least a portion of the outer surface of the insert, where the outer member is made from a different material than the base member. In a further example structure, the insert engages the channel to retain the insert within the channel, and the insert has an outer surface that is substantially flush with at least one immediately adjacent surface of the body. Still further example structures may include different combinations and variations of the preceding example structures, including additional aspects as described below, incorporated into a golf club head, such as a wood-type golf club head or other golf club head.

According to one aspect, a slot is positioned within the channel, and the insert further includes a projection extending from the base member and received within the slot to retain the insert within the channel. In one embodiment, the slot has an opening and the projection has an enlarged head that has a larger width than the opening. The projection is resiliently deflectable, and the enlarged head of the projection deforms during insertion into the slot to allow the enlarged head to pass into the opening, and then expands after the enlarged head has passed the opening to retain the projection within the slot.

According to another aspect, the body has a keel positioned along a center of the sole and extending rearward from the channel across at least a portion of the sole, and the keel is configured to be a lowest surface of the body in use. Additionally, the keel is defined by two opposed edges extending rearward from the channel, and at least a portion of the keel is raised with respect to adjacent surfaces of the sole. In one embodiment, the channel extends past the edges of the keel and into a heel portion and a toe portion of the body, and in another embodiment, the insert has an elongated length equal to a width of an adjacent section of the keel.

According to a further aspect, the channel is configured to flex and/or compress upon impact of the ball on the face, causing the base member of the insert to also flex and/or compress. The channel and/or the insert may exert a response force on the face upon impact of a ball on the face, due to the flexing and/or compression. In one embodiment, the response force is configured to force the bottom edge of the face outwardly upon impact of the ball on the face.

According to yet another aspect, the channel is elongated and extends generally parallel to one or more of the peripheral edges of the face. In one embodiment, the body has a spacing portion extending from the channel to the peripheral edge(s) of the face to space the channel from the peripheral edge(s).

According to a still further aspect, the base member is made from a resiliently deflectable material and an outer surface of the channel is configured for adhesion to the resiliently deflectable material. In one embodiment, the outer surface of the channel is rough and/or contains a plurality of grooves, and the resiliently deflectable material fills in the grooves to adhere the base member to the outer surface of the channel, and in another embodiment, a separate adhesive material may be applied between the channel and the insert.

According to an additional aspect, the outer member is a plate having a substantially flat outer surface and an inner surface contacting the base member. In one embodiment, the plate may be at least partially embedded within the base member of the insert.

According to another additional aspect, the outer member has a width that is smaller than the width of the channel, such that gaps exist between the outer member and the sides of the channel. In one embodiment, portions of the base member may fill these gaps.

According to a further additional aspect, the channel has a cross-sectional shape that includes a trough inwardly recessed from the body and two depending side walls extending from the trough to immediately adjacent surfaces of the body at the sides of the channel. In one embodiment, the outer surface of the insert is substantially flat, and an inner surface of the insert has a contour that is cooperatively dimensioned with the trough and side walls of the channel.

Additional aspects of the invention relate to wood-type golf club heads including a face having a ball striking surface configured for striking a ball, a body connected to the face and defining an enclosed volume between the face and the body, an inwardly recessed channel located on the sole of the body, and an insert positioned within the channel. The body has a keel positioned along a center of the sole of the body and extending rearward from the channel across at least a portion of the sole. The keel is configured to be a lowest surface of the body in use, and at least a portion of the keel is raised with respect to adjacent surfaces of the sole, with the keel having a tapered width that increases from the face toward a rear of the body. The channel extends transversely across the keel, and the channel is oriented generally parallel to the bottom edge of the face. The channel has a cross-sectional shape that includes a trough inwardly recessed from the body and two curvilinear depending side walls extending from the trough to the body at the sides of the channel. The channel also has a slot located in the trough. The insert has a substantially flat and/or smooth outer surface and an inner surface contoured for surface-to-surface engagement with the trough and the side walls of the channel. Additionally, the insert includes a flexible rubber base member, a metallic plate member connected to the base member by a mating connection and forming at least a major portion of the outer surface of the insert, and a flexible rubber projection integrally formed with the base member. The projection extends from the base member and is received within the slot to retain the insert within the channel. Further, the insert has an elongated length equal to the width of an adjacent section of the keel.

Further aspects of the invention relate to golf club kits that include a golf club head with a face, a body connected to the face, and a channel located on the body, as described above, along with a plurality of inserts each mounted within the channel. The inserts are alternately connectable to the golf club head. Additionally, the inserts are different from each other, such as having at least one of a different structure and a different material composition.

Still further aspects of the invention relate to methods in which a golf club head as described above is provided, including a face, a body connected to the face, a channel located on the body, and an insert mounted within the channel, as described above. The insert is connected to the head by mounting the insert within the channel. Additionally, the insert may be removed from the head and replaced by a second, different insert having at least one of a different structure and a different material composition. The method may further include connecting a shaft to the head.

Other aspects of the invention relate to golf clubs that include a head as described above and a shaft connected to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which:

FIG. 11 is a magnified cross-section view of a portion of a seventh illustrative embodiment of a head of a ball striking device according to the present invention;

FIG. 12 is a bottom perspective view of a portion of an eighth illustrative embodiment of a head of a ball striking device according to the present invention, showing the connection of an insert to the head;

FIG. 13 is a magnified cross-section view of a portion of a ninth illustrative embodiment of a head of a ball striking device according to the present invention;

DETAILED DESCRIPTION

Figure 1:
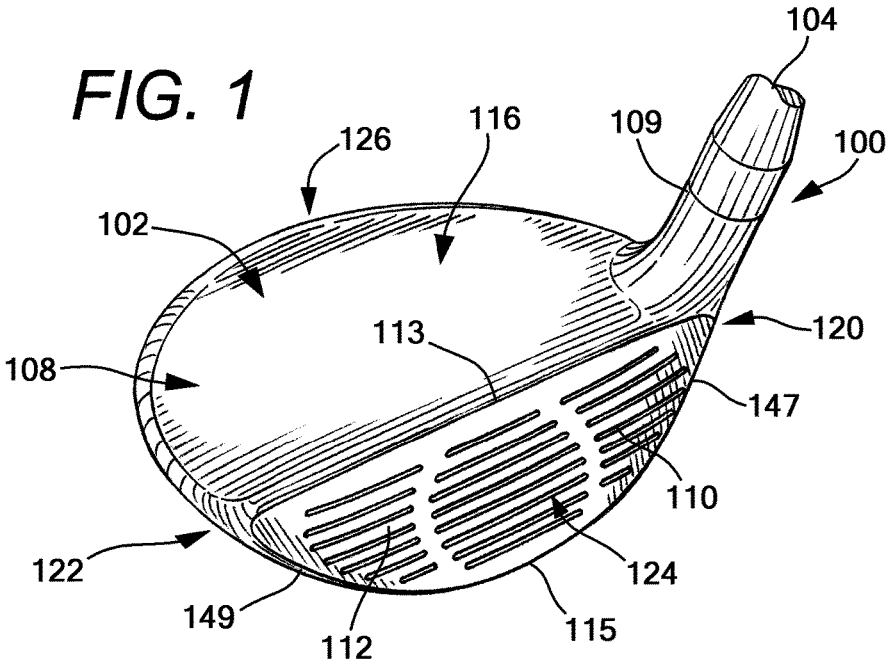
FIG. 1 is a top perspective view of an illustrative embodiment of a head of a ball striking device according to the present invention.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

"Transverse" means extending across or in a cross direction to a line, plane, edge, surface, etc., defined at an actual or virtual intersection point, but does not necessarily imply a perpendicular intersection.

"Flush" means that a surface of one article is level and aligned with the surface of an adjacent article, such that the two surfaces form a substantially flat single surface, within a tolerance of +/−0.005 inches. "Substantially flush" means that a surface of one article is level and aligned with the surface of an adjacent article, such that the two surfaces form a substantially flat single surface, within a tolerance of +/−0.05 inches.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface is a substantially flat surface on one face of the ball striking head. Some more specific aspects of this invention relate to wood-type golf clubs and golf club heads, including fairway woods, hybrid clubs, and the like, as well as other wood-type golf clubs such as drivers, although aspects of this invention also may be practiced on iron-type clubs, putters, and other club types as well.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as fairway woods and hybrid clubs, as well as other types of wood-type clubs, long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters. Such devices may include a one-piece construction or a multiple-piece construction. Example structures of ball striking devices according to this invention will be described in detail below in conjunction with FIG. 1, which illustrates one illustrative embodiment of a ball striking device 100 in the form of a fairway wood golf club (e.g., a 3-wood, 5-wood, 7-wood, etc.) or other wood-type club, including a hybrid club. Generally, such fairway wood-type clubs are capable of hitting a ball sitting directly on a playing surface, but can be used to hit a ball sitting on a tee as well.

The golf club 100 shown in FIGS. 1-5A includes a ball striking head 102 configured to strike a ball in use and a shaft 104 connected to the ball striking head 102 and extending therefrom. The ball striking head 102 of the golf club 100 of FIG. 1 has a face 112 connected to a body 108, with a hosel 109 extending therefrom. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties.

For reference, the head 102 generally has a top 116, a bottom or sole 118, a heel 120 proximate the hosel 109, a toe 122 distal from the hosel 109, a front 124, and a back or rear 126, as shown in FIGS. 1-5. The shape and design of the head 102 may be partially dictated by the intended use of the golf club 100. For example, it is understood that the sole 118 is configured to confront the playing surface in use. With clubs that are configured to be capable of hitting a ball resting directly on the playing surface, such as a fairway wood, hybrid, iron, etc., the sole 118 may contact the playing surface in use, and features of the club may be designed accordingly. In the club 100 shown in FIGS. 1-5A, the head 102 has an enclosed volume, as the club 100 is a wood-type club designed for use as a fairway wood, intended to hit the ball intermediate distances, with or without the use of a tee, which may include hitting the ball resting directly on the playing surface. In other applications, such as for a different type of golf club, the head 102 may be designed to have different dimensions and configurations. For example, when configured as a fairway wood, as shown in FIGS. 1-5A, the head 102 may have a volume of 120 cc to 230 cc, and if configured as a hybrid club, the head 102 may have a volume of 85 cc to 140 cc. If instead configured as a driver, the club head may have a volume of at least 400 cc, and in some structures, at least 450 cc, or even at least 460 cc. Other appropriate sizes for other club heads may be readily determined by those skilled in the art.

The body 108 of the head 102 can have various different shapes, including a rounded shape, as in the head 102 shown in FIGS. 1-5A, a squared or rectangular shape, or any other of a variety of other shapes. It is understood that such shapes may be configured to distribute weight away from the face 112 and/or the geometric/volumetric center of the head 102, in order to create a lower center of gravity and/or a higher moment of inertia.

In the illustrative embodiment illustrated in FIGS. 1-5A, the head 102 has a hollow structure defining an inner cavity 101 (e.g., defined by the face 112 and the body 108) with a plurality of inner surfaces defined therein. In one embodiment, the inner cavity 101 may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity 101 may not be completely enclosed in some embodiments.

Figure 2:
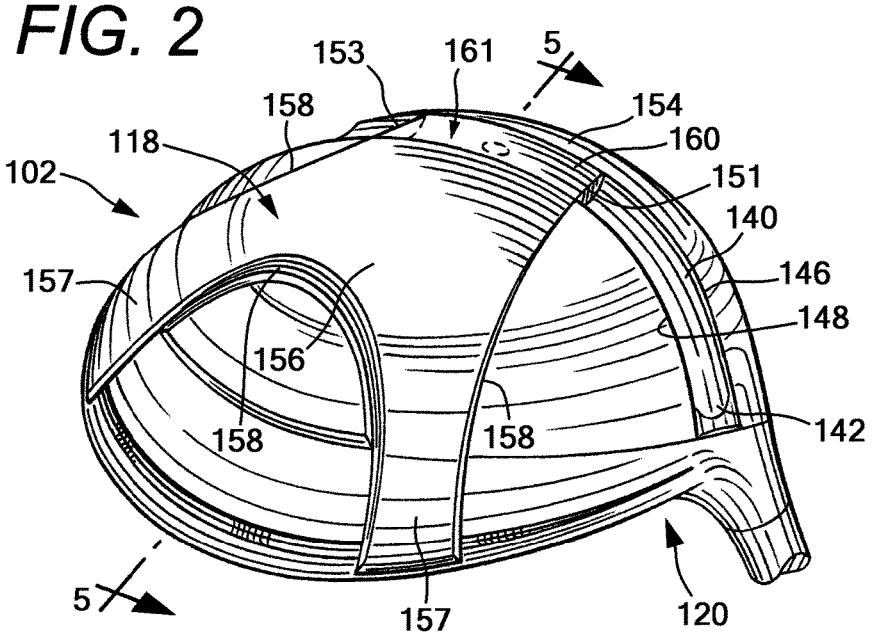
FIG. 2 is a bottom perspective view of the head of FIG. 1.
Figure 3:
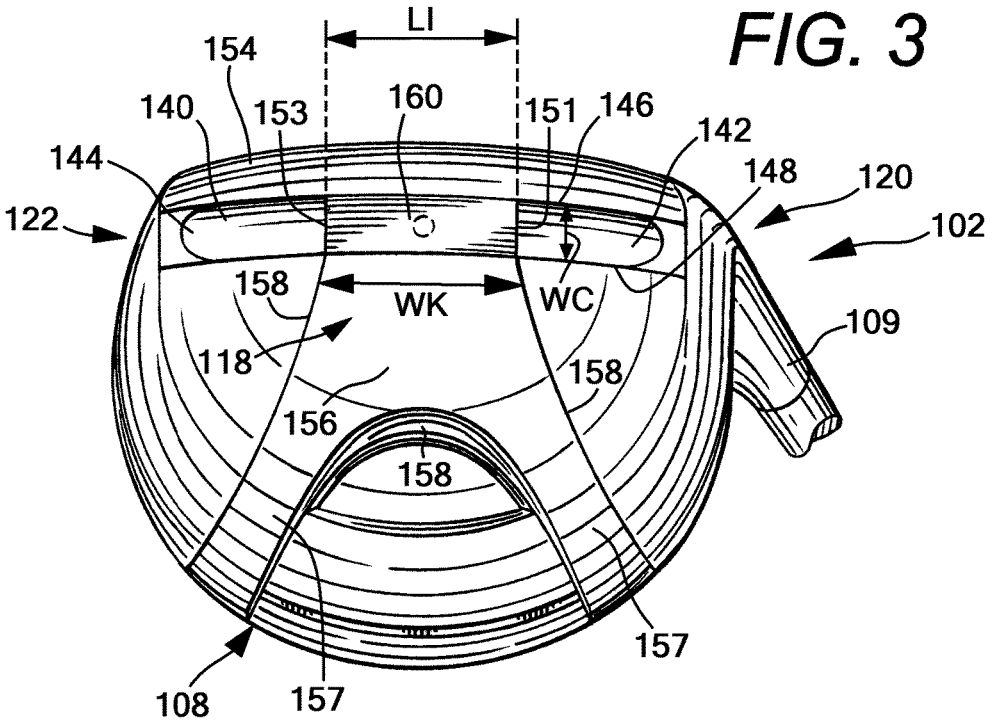
FIG. 3 is a bottom view of the head of FIG. 1.
Figure 4:
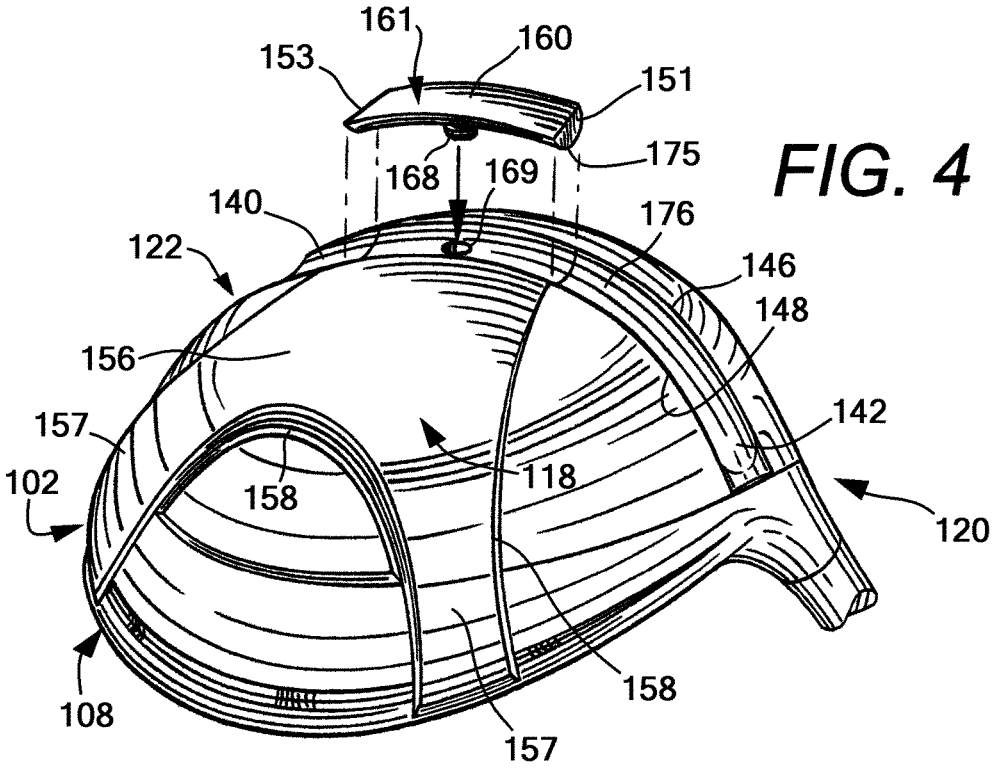
FIG. 4 is a bottom perspective view of the head of FIG. 1, showing the connection of an insert to the head.
Figure 5:
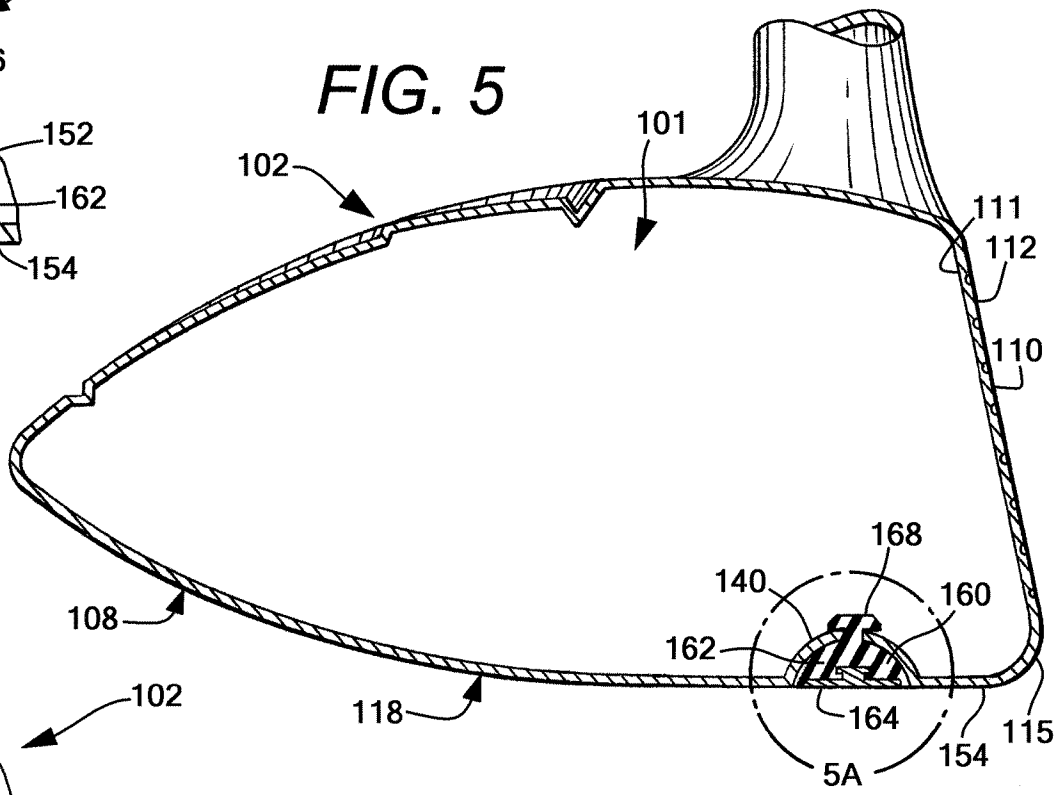
FIG. 5 is a cross-section view of the head of FIG. 1, taken along lines 5-5 of FIG. 2.
Figure 14:
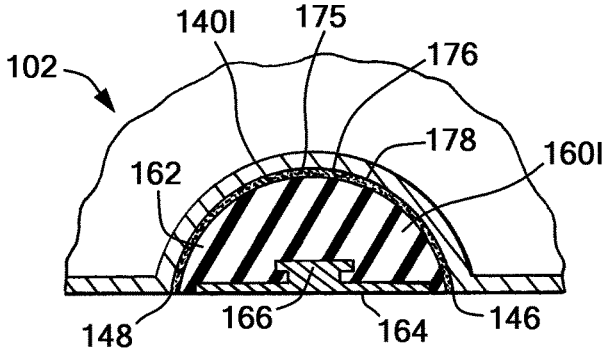
FIG. 14 is a magnified cross-section view of a portion of a tenth illustrative embodiment of a head of a ball striking device according to the present invention.
Figure 15:
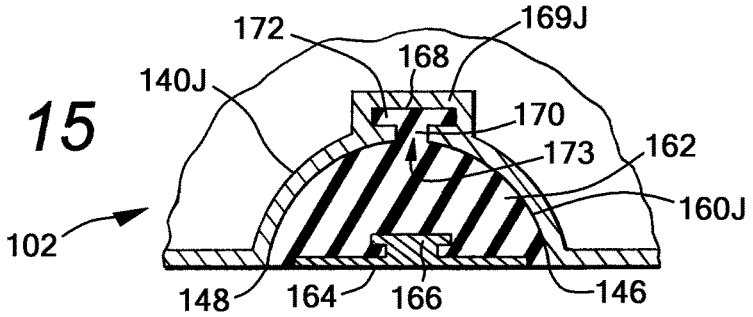
FIG. 15 is a magnified cross-section view of a portion of a eleventh illustrative embodiment of a head of a ball striking device according to the present invention.

The face 112 is located at the front 124 of the head 102, and has a ball striking surface 110 located thereon and an inner surface 111 opposite the ball striking surface 110, as illustrated in FIGS. 1, 3, and 5. The ball striking surface 110 is typically an outer surface of the face 112 configured to face a ball 106 in use, and is adapted to strike the ball 106 when the golf club 100 is set in motion, such as by swinging, as shown in FIGS. 14-15. As shown, the ball striking surface 110 is relatively flat, occupying at least a majority of the face 112. The face 112 has a plurality of outer or peripheral edges, including a top edge 113, a bottom edge 115, and lateral edges (including heel edge 147 and toe edge 149). The edges of the face 112 may be defined as the boundaries of an area of the face 112 that is specifically designed to contact the ball 106 in use, and may be recognized as the boundaries of an area of the face 112 that is intentionally flattened and smoothed to be suited for ball contact. For reference purposes, the portion of the face 112 nearest the top face edge 113 and the heel 120 of the head 102 is referred to as the "high-heel area"; the portion of the face 112 nearest the top face edge 113 and toe 122 of the head 102 is referred to as the "high-toe area"; the portion of the face 112 nearest the bottom face edge 115 and heel 120 of the head 102 is referred to as the "low-heel area"; and the portion of the face 112 nearest the bottom face edge 115 and toe 122 of the head 102 is referred to as the "low-toe area". Conceptually, these areas may be recognized and referred to as quadrants of substantially equal size (and/or quadrants extending from a geometric center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIGS. 1-5A, the ball striking surface 110 is inclined (i.e., at a loft angle), to give the ball 106 a desired lift and spin when struck. In other illustrative embodiments, the ball striking surface 110 may have a different incline or loft angle, to affect the trajectory of the ball 106. Additionally, the face 112 may have a variable thickness, and also may have one or more internal or external inserts and/or supports in some embodiments.

It is understood that the face 112, the body 108, and/or the hosel 109 can be formed as a single piece or as separate pieces that are joined together. The face 112 may be formed as part of a face frame member with the body 108 being partially or wholly formed by one or more separate pieces connected to the face frame member, with a wall or walls extending rearward from the edges of the face 112. This configuration is also known as a "cup face" structure. Additionally, at least a portion of the body 108 may be formed as a separate piece or pieces joined to the wall(s) of the face frame member, such as by a backbody member attached to the cup face structure, composed of a single piece or multiple pieces. These pieces may be connected by an integral joining technique, such as welding, cementing, or adhesively joining. Other known techniques for joining these parts can be used as well, including many mechanical joining techniques, including releasable mechanical engagement techniques. If desired, the hosel 109 may be integrally formed as part of the face frame member. Further, a gasket (not shown) may be included between the cup face structure and the backbody member.

The golf club 100 may include a shaft 104 connected to or otherwise engaged with the ball striking head 102 as shown schematically in FIGS. 1 and 5. The shaft 104 is adapted to be gripped by a user to swing the golf club 100 to strike the ball. The shaft 104 can be formed as a separate piece connected to the head 102, such as by connecting to the hosel 109, as shown in FIGS. 1 and 5. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element (not shown) may be positioned on the shaft 104 to provide a golfer with a slip resistant surface with which to grasp golf club shaft 104. The grip element may be attached to the shaft 104 in any desired manner, including in conventional manners known and used in the art (e.g., via adhesives or cements, threads or other mechanical connectors, swedging/swaging, etc.).

In general, the ball striking heads 102 according to the present invention contain features on the body 108 that influence the impact of a ball on the face 112. Such features include one or more compression channels 140 positioned on the body 108 of the head 102 that allow at least a portion of the body 108 to flex, produce a reactive force, and/or change the behavior or motion of the face 112, during impact of a ball on the face 112. In one embodiment, at least a portion of the compression channel(s) 140 may extend parallel or generally parallel to one of the adjacent edges of the face 112. In the golf club 100 shown in FIGS. 1-5A, the head 102 includes a single channel 140 located on the sole 118 of the head 102. As described below, this channel 140 permits compression and flexing of the body 108 during impact on the face 112, and can also produce a reactive force that can be transferred to the ball. This illustrative embodiment 100 is described in greater detail below.

The golf club 100 shown in FIGS. 1-5A includes a compression channel 140 positioned on the sole 118 of the head 102. However, in other embodiments, the head 102 may have a channel 140 positioned differently on the head 102, such as on the top 116, the heel 120, and/or the toe 122. It is also understood that the head 102 may have more than one channel 140, or may have an annular channel extending around the entire head 102. As illustrated in FIGS. 2-4, the channel 140 of this example structure is elongated, extending between a first end 142 located proximate the heel 120 of the head 102 and a second end 144 located proximate the toe 122 of the head 102. The channel 140 has a boundary that is defined by a first side 146 and a second side 148 that extend between the ends 140, 142. In this embodiment, the channel 140 extends adjacent to and parallel or generally parallel to the bottom edge 115 of the face 112, and further extends into the heel 120 and toe 122 of the head 102, extending parallel or generally parallel to the heel and toe edges 147, 149 of the face 112. As seen in FIG. 3, the channel 140 is substantially symmetrically positioned on the head 102 in this embodiment. In other embodiments, the channel 140 may be oriented and/or positioned differently. For example, the channel 140 may be oriented to be parallel to a different edge of the face 112, or may not be parallel to any of the edges of the face 112.

The channel 140 is recessed inwardly with respect to the immediately adjacent surfaces of the head 102 that are in contact with the sides 146, 148 of the channel 140, as shown in FIGS. 2-5A. The channel 140 in this embodiment has a generally semi-circular cross-sectional shape or profile, with a trough 150 and sloping, depending side walls 152 that are smoothly curvilinear, extending from the trough 150 to the respective sides 146, 148 of the channel 140. It is understood that the channel 140 may have a different cross-sectional shape or profile, such as the channel 140H illustrated in FIG. 13, and the channel 140 may have a sharper and/or more polygonal shape in some embodiments. Additionally, in the embodiment shown in FIGS. 5 and 5A, the wall thickness (T1) of the body 108 is reduced at the channel 140, as compared to the thickness (T2) at other locations of the body 108, to provide for increased flexibility at the channel 140. In one embodiment, the wall thickness in the channel 140 is from 0.8-1.5 mm.

Figure 5A:
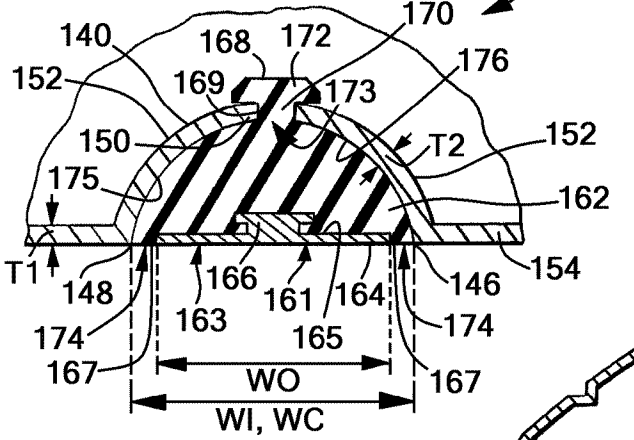
FIG. 5A is a magnified view of a portion of the head of FIG. 5.

In the embodiment shown in FIGS. 2-5A, the channel 140 is spaced from the bottom edge 115 of the face 112, with a flattened spacing portion 154 defined between the channel 140 and the bottom edge 115. The spacing portion 154 is located immediately adjacent the channel 140 and junctures with one of the side walls 152 of the channel 140 along the first side 146 of the channel 140, as shown in FIG. 5A. In this embodiment, the spacing portion 154 is oriented at an acute (i.e.)<90° angle to the ball striking surface 110 and extends rearward from the bottom edge 115 of the face 112 to the channel 140. Force from an impact on the face 112 can be transferred to the channel 140 through the spacing portion 154, as described below. In other embodiments, the spacing portion 154 may be oriented at a right angle or an obtuse angle to the ball striking surface 110, or the flattened spacing portion 154 may be smaller than shown in FIGS. 2-5A or absent entirely.

As also shown in FIGS. 2-5, the sole 118 of the head 102 has a keel 156 that extends rearward on the sole 118. In this embodiment, the keel 156 extends rearward from the channel 140 toward the rear 126 of the head 102. Additionally, the keel 156 forms the lower extremity of the sole 118 and confronts the playing surface in use, and at least a portion of the keel 156 is raised with respect to adjacent portions of the sole 118. As shown in FIGS. 2-5, at least a portion of the keel 156 is defined by edges formed by shoulders 158 that raise the keel 156 above the adjacent portions of the sole 118 in contact with the shoulders 158. As also seen in FIG. 4, the width of the keel 156 increases toward the rear 126 of the head 102, and the keel 156 splits into two legs 157 that separate further toward the rear 126 of the head 102.

In the embodiment shown in FIGS. 1-5, the channel 140 extends across the entire width of the keel 156. The keel 156 forms part of a substantially smooth surface of the sole 118 extending from the bottom edge 115 of the face 112 toward the rear 126 of the head 102, except for the discontinuity caused by the channel 140. It is understood that in this embodiment, the keel 156 has a substantially smooth curvilinear shape, as well as a substantially smooth surface texture, and that the term, "substantially smooth surface" can refer to either or both of the substantially smooth contour and surface texture of the surface. It is also understood that the substantially smooth surface may have some discontinuity, such as a logo or other marking, and still be considered substantially smooth. In this embodiment, the smooth surface of the keel 156 is polished to further increase the smoothness of the surface texture. Also, the keel 156 may be made of any desired material, including materials conventionally used in golf club head construction as are known in the art (e.g., metals, metal alloys, composites, polymers, etc.).

The smooth contour and texture of the substantially smooth surface of the keel 156 provide for decreased friction and/or other forces on the sole 118 if the sole 118 contacts the playing surface in use. Accordingly, forces on the sole 118 which may slow the speed of the head 102, alter the orientation or position of the head 102, and/or otherwise affect the swinging motion of the head 102 can be reduced appreciably. This configuration provides advantages when incorporated into fairway woods, hybrid clubs, or other such golf clubs which may be used to hit a ball resting directly on a playing surface, resulting in possible contact between the sole 118 and the playing surface in use. Nevertheless, it is understood that the features described herein can be advantageous when incorporated into a different type of golf club, including a driver or non-wood-type clubs such as irons and putters, as well as other ball striking devices.

The head 102 has an insert 160 connected to the head 102 and positioned within the channel 140. In general, the insert 160 at least partially fills at least a portion of the channel 140, and extends over at least a portion of the length of the channel 140. In one embodiment, at least a portion of the insert 160 may be made from a different material than the face 112 and/or the body 108 of the head 102. Additional features of the insert 160 are described below with respect to multiple different embodiments.

Figure 6:
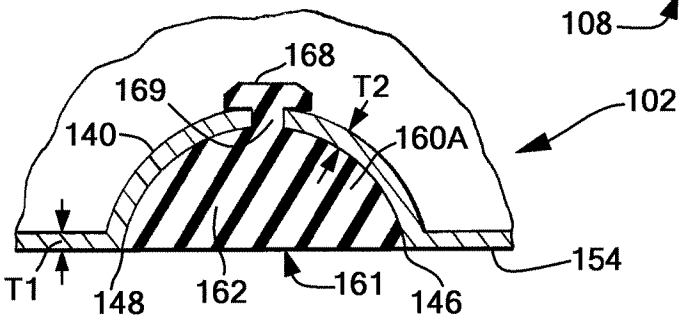
FIG. 6 is a magnified cross-section view of a portion of a second illustrative embodiment of a head of a ball striking device according to the present invention.

The insert 160 shown in FIGS. 2-5A includes a base member 162 and an outer member 164 forming at least a portion of the outer surface 161 of the insert 160, as seen in greater detail in FIGS. 5-5A. As shown in FIGS. 2-5A, in this embodiment, the base member 162 is a filler member that engages the channel 140 and is connected to the channel 140, and the outer member 164 is a plate member that forms at least a major portion of the outer surface 161 of the insert 160. In one embodiment, the base member 162 is formed of a resiliently deflectable material, for example polyurethane rubber or another similar flexible polymer material. In other embodiments, the resiliently deflectable material may be another material that is resiliently deflectable, including a variety of flexible materials that are elastically or otherwise non-permanently deformable, such as other polymers or ductile metals. The resiliently deformable material may also generate a responsive force when compressed, as described below. Additionally, in one embodiment, the outer member 164 is formed of a rigid material having greater strength and/or rigidity than the resiliently deflectable material. For example, the rigid material is a metallic material in one embodiment, such as stainless steel, aluminum, or other suitable metallic material. In another embodiment, the rigid material may be a metallic material that is also used in the face 112 and/or other portions of the head 102, such as steel, titanium, or titanium alloy. In further embodiments, another rigid material may be used, including hard polymers, composites (including graphite fiber composites), ceramics, other metallic materials, etc. It is understood that in other embodiments, the insert 160 may contain additional members, including multiple or layered outer members, or may contain only a single base member 162 with no outer members as shown in FIG. 6.

The base member 162 and the outer member 164 may be connected together in a mating configuration in some embodiments, such as embedding the outer member 164 at least partially within in the base member 162. In the embodiment shown in FIGS. 2-5A, the inner surface 165 of the outer member 164 includes a projection 166 that is embedded within the base member 162 in a complementary mating arrangement. Additionally, the entire body of the outer member 164 is partially embedded within the base member 162, such that only the outer surface 163 of the outer member 164 is exposed. As seen in FIG. 5A, the width WO of the outer member 164 is narrower than the width WI of the insert 160, such that portions 167 of the base member 162 extend around the sides of the outer member 164 to form part of the outer surface 161 of the insert 160. This connection can be made, in one embodiment, by subsequent forming of the base member 162 around the outer member 164, such as by pouring or injecting the material of the base member 162 in a fluid or flowable state (such as molten, dissolved, non-polymerized, etc.) so that the base member 162 forms with the outer member 164 embedded therein. In other embodiments, the components can be connected in other ways, including separately forming the base member 162 with a complementarily-shaped recess and subsequently connecting the outer member 164 (e.g., using an adhesive).

The insert 160 may be mounted within the channel 140 in a variety of different manners. In one embodiment, the insert 160 may be configured for complementary mating connection to the head 102. For example, in the embodiment in FIGS. 2-5A, the insert 160 includes a projection 168 that is received within a slot 169 in the head 102 to mount the insert 160 within the channel 140. The slot 169 in the embodiment of FIGS. 4-5A is located within the channel 140, on the trough 150 of the channel 140. As shown in FIGS. 4-5A, the projection 168 includes stem 170 and an enlarged head 172, and is integrally formed as a single piece with the base member 162, such that the projection 168 is also resiliently deflectable. The enlarged head 172 is adapted to engage one or more inner surfaces of the slot 169 to retain the projection 168 in the slot 169. As also shown in FIGS. 4-5A, the slot 169 includes an opening 173 and extends completely through the wall of the body 108 and into the inner cavity 101. In this embodiment, the head 172 is larger than the opening 173 of the slot 169, and the head 168 is resiliently deflectable and configured to deform during insertion into the slot 169 to allow the head 172 to pass into the opening 173 and to expand after the head 172 has passed the opening 173 to retain the projection 168 within the slot 169. Other types of connections are also possible, including the connections described below and shown in FIGS. 7, 9, and 14-17, as well as other suitable connection types.

In the embodiment shown in FIGS. 2-4, the insert 160 is an elongated member that is elongated between opposed ends 151, 153 in the same direction as the channel 140, and is mounted within the channel 140 such that the elongated length LI of the insert 160 is less than the length of the channel 140. Additionally, in this embodiment, the insert 160 is positioned adjacent the keel 156, and the length LI of the insert 160 is equal or substantially equal to the width WK of the section of the keel 156 that is immediately adjacent to the channel 140. In other words, the adjacent portions of the shoulders 158 of the keel 156 are aligned with the ends 151, 153 of the insert 160. In another embodiment, the insert 160 may have a greater or smaller length. For example, the insert 160 may have a length that is greater or smaller than the width of the keel 156, or the insert 160 may have a length equal to the channel 140 and may fill the entire channel 140. In additional embodiments, the insert 160 may be located off-center in the channel 140 or in other strategic locations, and may or may not overlap the center of the channel 140 and/or the center of the keel 156. In a further embodiment, the insert 160 may be formed of multiple pieces that are placed at one or more strategic locations within the channel 140.

In the embodiment shown in FIGS. 2-5A, the insert 160 has a width WI that is substantially equal to the width WC of the channel 140, measured transverse to the direction of elongation of the insert 160 and the channel 140. Additionally, the width WO of the outer member 164 of the insert 160 is smaller than the width WC of the channel 140, such that gaps 174 are formed between the outer member 164 and the sides 146, 148 of the channel 140, as shown in FIGS. 5-5A. As described below, these gaps 174 can provide room for the insert 160 to be compressed without deforming the outer member 164.

In one embodiment, the outer surface 161 of the insert 160 is substantially flat and is flush or substantially flush with the immediately adjacent surfaces of the body 108. In the embodiment shown in FIGS. 2-5A, the outer surface 161 of the insert 160 is substantially flush with the adjacent surfaces of the body 108 that contact the sides 146, 148 of the channel 140. Additionally, in this embodiment, the outer surface 161 of the insert 160 is substantially flat, and the outer surface 163 of the outer member 164 is substantially flat and is also substantially flush with the adjacent surfaces of the body 108. The insert 160 further has an inner surface 175 that may be contoured to fit within the channel 140, and may be contoured and dimensioned for surface-to-surface engagement with the channel 140. In the embodiment shown in FIGS. 2-5A, the inner surface 175 of the insert 160 is cooperatively dimensioned to have substantially the same curvilinear contour as the outer surface 176 of the channel 140, and has a semicircular shape to conform to the trough 150 and side walls 152 of the channel 140. It is understood that in another embodiment, where the channel 140 may have a different cross-sectional shape, the insert 160 may also have a different contour and cross-sectional shape.

Figure 19:
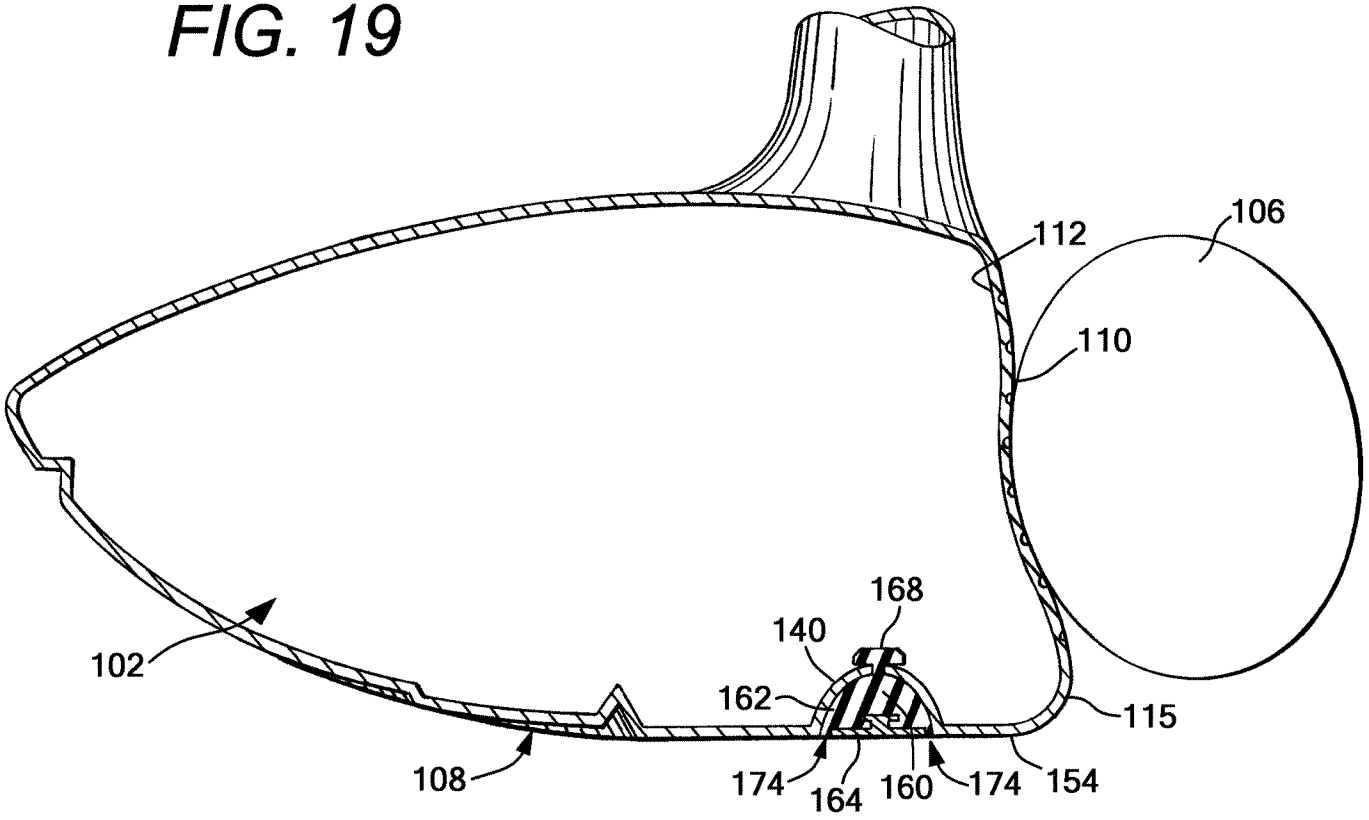
FIG. 19 is a cross-section view of the head as shown in FIG. 5, during impact of a ball on a ball striking face of the head.
Figure 20:
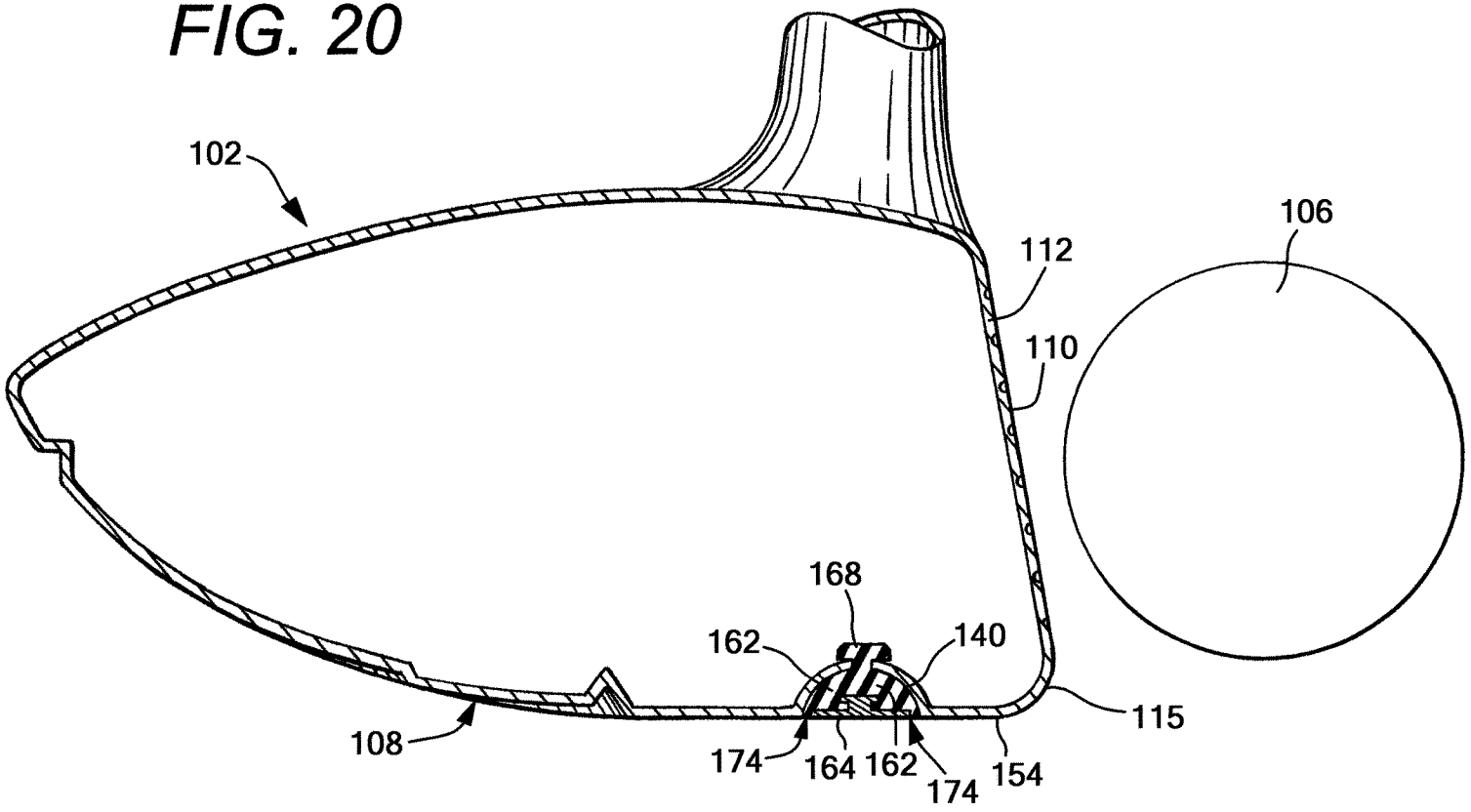
FIG. 20 is a cross-section view the head as shown in FIG. 19, immediately after the impact.
Figure 21:
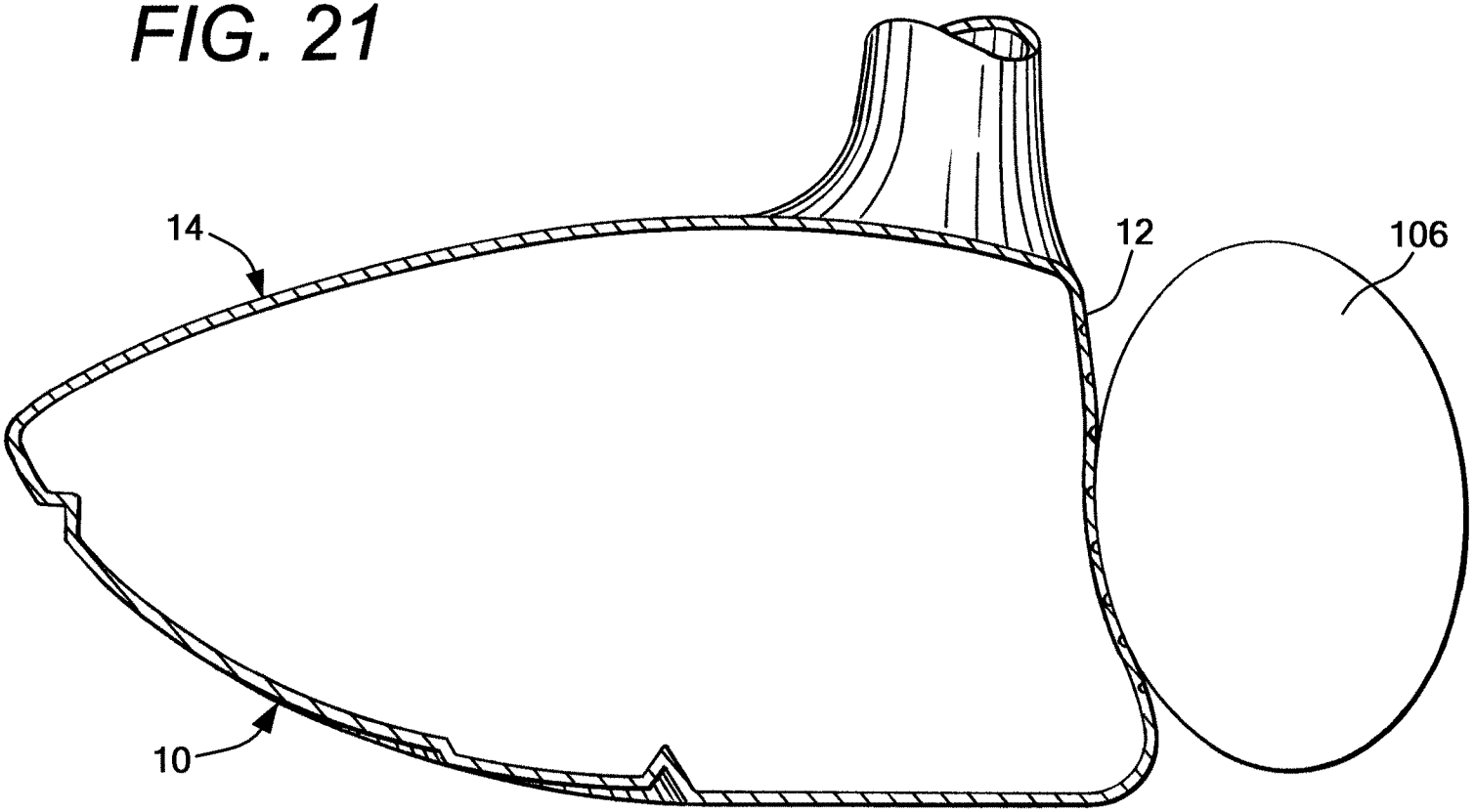
FIG. 21 is a cross-section view of a head of a typical ball striking device during impact of a ball on a ball striking face of the head.

The compression channel 140 on the golf club 100 shown in FIGS. 1-5 can influence the impact of a ball 106 on the face 112 of the head 102. In one embodiment, the channel 140 can influence the impact by flexing and/or compressing in response to the impact on the face 112, and/or by exerting a reaction force on the face 112 during impact. FIGS. 19-20 illustrate an example of the head 102 of the golf club 100 of FIGS. 1-5 during and after an impact with a ball 106, respectively. For comparison, FIG. 21 illustrates a typical example of an existing ball striking head 10, having a face 12 and a body 14, during impact with a similar ball 106. As seen in FIG. 19, when the ball 106 impacts the face 112, the face 112 flexes inwardly. Additionally, some of the impact force is transferred through the spacing portion 154 to the channel 140, causing the sole 118 to flex at the channel 140, as also seen in FIG. 19. This flexing, which results in a smaller degree of deformation of the ball 106 as compared to the traditional head 10, as illustrated in FIGS. 19-21. This smaller degree of deformation can result in greater impact efficiency and greater energy and velocity transfer to the ball 106 during impact. The more gradual impact created by the flexing also creates a longer impact time, which can result in greater energy and velocity transfer to the ball 106 during impact. As also shown in FIG. 19, the insert 160 compresses and/or deforms with the compression of the channel 140, and the gaps 174 between the edges of the rigid outer element 164 and the sides 146, 148 of the channel 140 can provide room for the channel 140 to compress without deforming the outer element 164 (note the size and shape differences of the channel 140 and insert 160 in a comparison of FIGS. 19 and 20). Further, as the compressed channel 140 and insert 160 expand to return to their initial shapes (i.e., FIG. 20), a responsive or reactive force is exerted on the face 112, creating an increased "trampoline" effect, which can result in greater energy and velocity transfer to the ball 106 during impact. Still further, because the channel 140 extends toward the heel 120 and toe 122, and overlaps the heel and toe edges 147, 149 of the face 112, the head 102 can achieve increased energy and velocity transfer to the ball 106 for impacts that are away from the center or traditional "sweet spot" of the face 112. It is understood that a channel 140 may be additionally or alternately incorporated into the top 116 and/or sides 120, 122 of the body 108 in order to produce similar effects for energy and velocity transfer.

The insert 160 can also assist in reducing or eliminating drag or other forces between the sole 118 of the head 102 and the playing surface in use. When hitting a ball 106 directly on a playing surface, the channel 140 may tend to catch or drag on the playing surface during a swing. The insert 160 fills the channel 140 at the center of the sole 118 and/or across the lowest point on the sole 118, which assists in minimizing or eliminating any interaction between the channel 140 and the playing surface in use, which may exert increased drag or other forces on the sole 118. Accordingly, forces on the sole 118 which may slow the speed of the head 102, alter the orientation or position of the head 102, and/or otherwise affect the swinging motion of the head 102 can be reduced appreciably. The rigid outer member 164, if present, can assist in reducing the drag and other forces, by providing a smooth, rigid surface that can glide along the playing surface more easily. Additionally, the fact that the outer surface 161 of the insert 160 is substantially flush with the adjacent surfaces of the body 108 creates a smoother surface that is less prone to creation of drag forces during contact with the playing surface. The smooth keel 156 can further assist in decreasing such drag or other forces. Accordingly, the head 102 described above can provide advantages when incorporated into fairway woods, hybrid clubs, or other such golf clubs which may be used to hit a ball sitting directly on a playing surface, resulting in possible contact between the sole 118 and the playing surface in use. Nevertheless, it is understood that the features described herein can be advantageous when incorporated into a different type of golf club, including a driver or non-wood-type clubs such as irons and putters, as well as other ball striking devices.

It is understood that the head 102 may have one or more channels 140 in a different configuration in other embodiments. In one embodiment, the head 102 may include a channel in similar configuration to the channel 140 of FIGS. 1-5, but containing no insert 160. Such a configuration may be desirable for a driver-type club, which is intended to hit the ball from a tee and generally is not intended to be used to hit a ball at rest on the playing surface, but could also be used for a different type of club, such as a fairway wood or iron-type club. In another embodiment, the head 102 may have one or more channels on the top 116, the heel 120, and/or the toe 122, either instead of or in combination with a channel 140 on the sole 118. In a further embodiment, the head 102 may have one or more channels on an interior surface of the body 108, rather than on the exterior. In yet another embodiment, the head 102 may have two or more channels 140 spaced different distances from the face 112, and these channels 140 may "overlap" each other, creating a bellows-like effect in compression. Any or all of such channels 140 may contain an insert 160 mounted therein. Still other embodiments are contemplated.

It is also understood that the head 102 may have one or more inserts 160 in a different configuration in other embodiments. In one embodiment, a single channel 140 may contain multiple inserts 160, which may have similar or different properties and characteristics. The channel 140 may include inserts 160 having desired properties at different locations on the channel 140 to provide different properties at those locations. For example, different inserts 160 having different weights or densities can be placed in the channel 140 at desired locations to influence the weight distribution of the head 102, such as to increase moment of inertia, control the center of gravity, or customize the weighting to a particular user's swing characteristics, among others. As another example, different inserts 160 having different flexibilities can be placed in the channel 140 at desired locations to influence the flexibility of the channel 140 at such locations and/or the performance of the face 112 proximate such locations. As a further example, the channel 140 may include an insert 160 with a rigid outer element 164 near the centerline of the body 108 and may contain inserts 160 without outer elements 164 closer to the heel 120 and/or toe 122 of the head 102. It is understood that these objectives can be provided by a single insert 160 with different properties, such as a weight or flexibility gradient. In another embodiment, the size, shape, or location of a single insert 160 can be changed to provide different performance. For example, moving the insert 160 to a different location away from the centerline of the body 108 can change the properties of the head 102, such as the weight distribution of the head 102, the flexibilities of different portions of the channel 140, etc. This can provide options for customization for a particular user's swing characteristics, such as moving the insert 160 toward the heel 120 or toe 122 to change the weighting the head 102 based on the user's swing. Still other embodiments are contemplated.

FIGS. 6-17 illustrate additional different embodiments of a ball striking head 102 according to the present invention, showing different types of inserts 160A-M connected to the head 102. FIGS. 6-17 each illustrate only a portion of the head 102 of each particular embodiment, and it is understood that the portions of the head 102 that are not shown may be configured similarly to the embodiment described above and shown in FIGS. 1-5A (or may have any other desired constructions). Accordingly, the components of FIGS. 6-17 are numbered with similar reference characters when such components are similar to corresponding components in the embodiment described above and shown in FIGS. 1-5A. It is understood that any of the features of FIGS. 6-17 may be incorporated into another head of any suitable configuration, including any of the variations described above with respect to FIGS. 1-5A. It is also understood that the embodiments described below with respect to FIGS. 6-17 may retain some or all of the functionality of the head 102 in FIGS. 1-5 as described above, and may offer additional or different functionality.

FIG. 6 illustrates an example embodiment of a head 102 that includes a channel 140 as described above with respect to FIGS. 1-5A and an insert 160A mounted within the channel 140, where the insert 160A includes only a base member 162 and no outer member 164 connected to the base member 162. Accordingly, the base member 162 forms the entire outer surface 161 of the insert 160A in this embodiment, and the outer surface 161 is substantially flat and substantially flush with the immediately adjacent surfaces of the body 108 at the sides 146, 148 of the channel 140. In this embodiment, the base member 162 has a projection 168 received within a slot 169 to mount the insert 160A within the channel 140, similar to the insert 160 in FIG. 5A.

Figure 7:
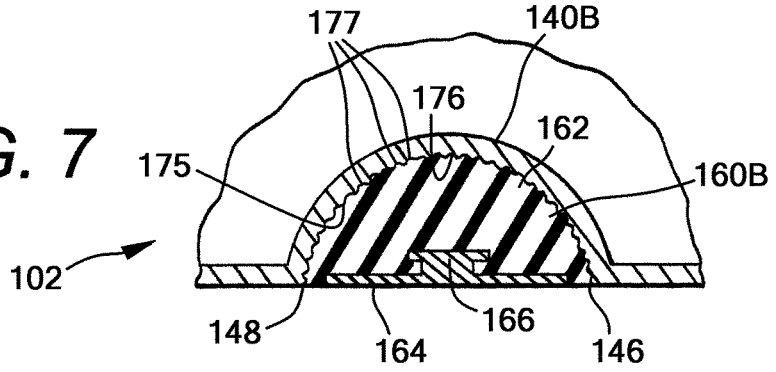
FIG. 7 is a magnified cross-section view of a portion of a third illustrative embodiment of a head of a ball striking device according to the present invention.

FIG. 7 illustrates an example embodiment of a head 102 that includes a channel 140B and an insert 160B mounted within the channel 140B, where the insert 160B is connected to the channel 140B by adhesion to the outer surface 176 of the channel 140B. Like the insert 160 in FIG. 5A, the insert 160B includes a base member 162 made of a resiliently deflectable material and an outer member 164 in the form of a rigid plate connected to the base member 162. In this embodiment, the outer surface 176 of the channel 140B is rough and contains a plurality of grooves 177, and the material of the base member 162 of the insert 160B fills in the grooves to adhere the base member 162 to the outer surface 176 of the channel 140B. This configuration can be created, in one embodiment, by pouring the material of the base member 162 into the channel 140B in fluid form and allowing the material to solidify to form the base member 162. Accordingly, in this embodiment, the insert 160B may be a filler material that fills part or all of the channel 140B, rather than a separately formed and designed insert. As described above, the outer member 164 can be partially embedded within the base member 162 by simultaneously solidifying the material of the base member 162 around the outer member 164 as well. Additionally, the grooves 177 may be formed in the outer surface 176 of the channel 140B using different methods. In one example, the outer surface 176 of the channel may be formed with designed grooves 177 therein, such as by molding, forging, etc. In another example, the grooves 177 may be created in the outer surface 176 of the channel by sanding, machining, etching, or other post-forming treatment or surface treatment. It is understood that other methods of manufacturing can be used to create this embodiment.

Figure 8:
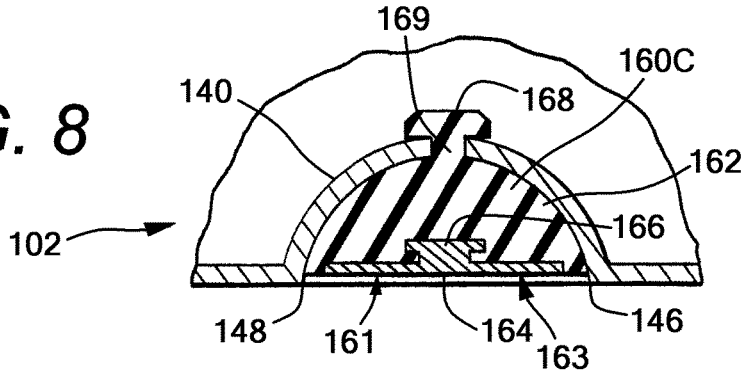
FIG. 8 is a magnified cross-section view of a portion of a fourth illustrative embodiment of a head of a ball striking device according to the present invention.

FIG. 8 illustrates an example embodiment of a head that includes a channel 140 as described above with respect to FIGS. 1-5A and an insert 160C mounted within the channel 140, where the outer surface 161 of the insert 160C is not flush with the immediately adjacent surfaces of the body 108. Like the insert 160 in FIG. 5A, the insert 160C includes a base member 162 made of a resiliently deflectable material and an outer member 164 in the form of a rigid plate connected to the base member 162, with a projection 168 connected to the base member 162 and received within a slot 169 to mount the insert 160C within the channel 140. As seen in FIG. 8, the outer surface 161 of the insert 160C is recessed from the adjacent surfaces of the body 108 located at the sides 146, 148 of the channel 140. It is understood that in another embodiment, the head 102 may contain an insert that has an outer surface 161 that protrudes outwardly with respect to the adjacent surfaces of the body 108.

Figure 9:
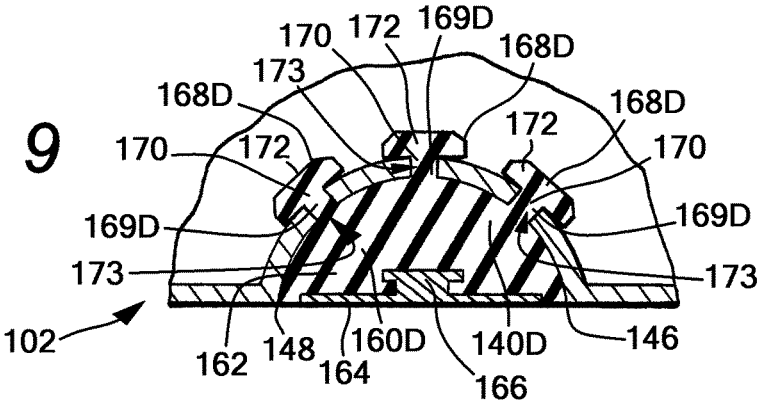
FIG. 9 is a magnified cross-section view of a portion of a fifth illustrative embodiment of a head of a ball striking device according to the present invention.

FIG. 9 illustrates an example embodiment of a head that includes a channel 140D and an insert 160D mounted within the channel 140, where the insert 160D includes a plurality of projections 168D that are received in a plurality of slots 169D to connect the insert 160D to the body 108. Like the insert 160 in FIG. 5A, the insert 160D includes a base member 162 made of a resiliently deflectable material and an outer member 164 in the form of a rigid plate connected to the base member 162. As shown in FIG. 9, in this embodiment, the base member 162 includes three projections 168D integrally formed with the base member 162, with each projection 168D received within one of three slots 169D to mount the insert 160D within the channel 140D. The three projections 168D are substantially aligned with each other across the width of the insert 160D, and form a radiating array of projections 160D. The slots 169D are similarly configured and positioned. Additionally, as described above with respect to FIG. 5A, each projection 168D is resiliently deflectable and includes stem 170 and an enlarged head 172. As also discussed with respect to FIG. 5A, each slot 169D includes an opening 173, and each head 172 is larger than the opening 173 of the corresponding slot 169D, such that the resiliently deflectable heads 172 are configured to deform during insertion into the slots 169D to allow the heads 172 to pass into the openings 173 and to expand after the heads 172 have passed the openings 173 to retain the projections 168D within the slots 169D. In other embodiments, the insert 160D may contain any number of projections 168D in a variety of different arrangements and configurations, and some or all of the projections 168D may not be formed integrally with the base member 162 of the insert 160D.

Figure 10:
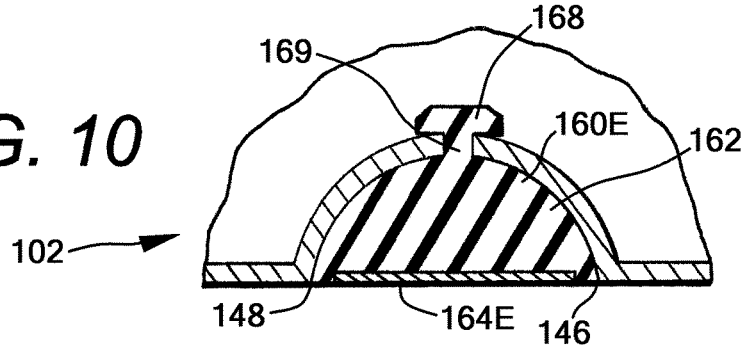
FIG. 10 is a magnified cross-section view of a portion of a sixth illustrative embodiment of a head of a ball striking device according to the present invention.

FIG. 10 illustrates an example embodiment of a head 102 that includes a channel 140 as described above with respect to FIGS. 1-5A and an insert 160E mounted within the channel 140, where the insert 160E includes a base member 162 and an outer member 164E partially embedded within the base member 162. As shown in FIG. 10, in this embodiment, the outer member 164E does not contain any projection or other protruding structure for mating engagement with the base member 162. The outer member 164E is connected to the base member 162 by embedding the outer member 164E partially within the base member 162 so that only the outer surface 163 of the outer member 164E is exposed. It is understood that adhesive material and/or a surface treatment on one or both of the base member 162 and the outer member 164E may be used to further strengthen the connection. In this embodiment, the base member 162 has a projection 168 received within a slot 169 to mount the insert 160E within the channel 140, similarly to the insert 160 in FIG. 5A.

FIG. 11 illustrates an example embodiment of a head 102 that includes a channel 140 as described above with respect to FIGS. 1-5A and an insert 160F mounted within the channel 140, where the insert 160F includes a base member 162F and an outer member 164 partially embedded within the base member 162. As shown in FIG. 11, in this embodiment, the outer member 164 is connected to the base member 162F by a projection 166 that is embedded within the base member 162F in a complementary mating arrangement. Additionally, in this embodiment, the outer member 164 has a smaller width than the channel 140, and the edge portions 167F of the base member 162F are tapered away from the outer surface 161 of the insert 160F. Accordingly, the gaps 174 between the edges of the outer member 164 and the sides 146, 148 of the channel 140 are not completely filled with material, unlike the insert 160 in FIG. 5A.

FIG. 12 illustrates an example embodiment of a head that includes a channel 140G and an insert 160G mounted within the channel 140, where the insert 160G includes a plurality of projections 168G that are received in a plurality of slots 169G to connect the insert 160G to the body 108. Like the insert 160 in FIG. 5A, the insert 160G includes a base member 162 made of a resiliently deflectable material and an outer member 164 in the form of a rigid plate connected to the base member 162. As shown in FIG. 12, in this embodiment, the base member 162 includes two projections 168G integrally formed with the base member 162, with each projection 168G received within one of two spaced slots 169G to mount the insert 160G within the channel 140G. The two projections 168G are substantially aligned with each other along the length of the insert 160G, and the slots 169G are similarly positioned along the length of the channel 140G. Additionally, as described above with respect to FIG. 5A, each projection 168G is resiliently deflectable and includes stem 170 and an enlarged head 172. As also discussed with respect to FIG. 5A, each slot 169G includes an opening 173, and each head 172 is larger than the opening 173 of the corresponding slot 169G, such that the resiliently deflectable heads 172 are configured to deform during insertion into the slots 169G to allow the heads 172 to pass into the openings 173 and to expand after the heads 172 have passed the openings 173 to retain the projections 168G within the slots 169G. In other embodiments, the insert 160G may contain any number of projections 168G in a variety of different arrangements and configurations, and some or all of the projections 168G may not be formed integrally with the base member 162 of the insert 160G.

FIG. 13 illustrates an example embodiment of a head that includes a channel 140H and an insert 160H mounted within the channel 140H, where the channel 140H and the insert 160H are shaped differently from the channel 140 and insert 160 in FIGS. 2-5A. In this embodiment, the channel 140H has a rectangular shape, with a substantially flat trough 150H and side walls 152H that angle sharply inward from the sides 146, 148 of the channel 140H. Similar to the channel 140 in FIG. 5A, in this embodiment, the wall thickness (T1) is reduced at the channel 140H, as compared to the thickness (T2) at other locations of the body, to provide for increased flexibility at the channel 140H. Like the insert 160 in FIG. 5A, the insert 160H includes a base member 162 made of a resiliently deflectable material and an outer member 164 in the form of a rigid plate connected to the base member 162, with a projection 168 connected to the base member 162 and received within a slot 169 to mount the insert 160H within the channel 140. In other embodiments, the channel 140H and/or the insert 160H may have different shapes.

FIG. 14 illustrates an example embodiment of a head 102 that includes a channel 140I and an insert 160I mounted within the channel 140I, where the insert 160I is connected to the channel 140I by adhesion to the outer surface 176 of the channel 140I. Like the insert 160 in FIG. 5A, the insert 160I includes a base member 162 made of a resiliently deflectable material and an outer member 164 in the form of a rigid plate connected to the base member 162. In this embodiment, an adhesive material 178 is applied between the outer surface 176 of the channel 140I and the base member 162 of the insert 160I to adhere the base member 162 to the outer surface 176 of the channel 140I. The nature of the adhesive material 178 may depend on the materials of the channel 140I and the insert 160I, and any adhesive material may be used, including any epoxy, cement, glue, or other adhesive material. Additionally, in this embodiment, the insert 160I may be a filler material that fills part or all of the channel 140I, rather than a separately formed and designed insert, and may be poured into the channel 140I in liquid form, as similarly described above. It is understood that one or both of the outer surface 176 of the channel 140I and the inner surface 175 of the insert 160I may be treated to enhance adhesion. In another embodiment, the insert 160I can be mounted within the channel 140I by welding, brazing, soldering, etc., depending on the material composition of the insert 160I.

FIG. 15 illustrates an example embodiment of a head 102 that includes a channel 140J and an insert 160J mounted within the channel 140J. Like the insert 160 in FIG. 5A, the insert 160J includes a base member 162 made of a resiliently deflectable material and an outer member 164 in the form of a rigid plate connected to the base member 162. In this embodiment, the base member 162 has a projection 168 received within a slot 169J to mount the insert 160J within the channel 140, similarly to the insert 160 in FIG. 5A. However, in this embodiment, the slot 169J does not extend completely through the wall of the body 108 as in FIG. 5A, but rather, is formed as a closed notch within the wall of the body 108. Additionally, as similarly described above with respect to FIG. 5A, the projection 168 is resiliently deflectable and includes stem 170 and an enlarged head 172, and the slot 169J includes an opening 173. The head 172 is larger than the opening 173 of the slot 169J, such that the resiliently deflectable head 172 is configured to deform during insertion into the slot 169J to allow the head 172 to pass into the opening 173 and to expand after the head 172 has passed the opening 173 to retain the projection 168 within the slot 169J.

Figure 16:
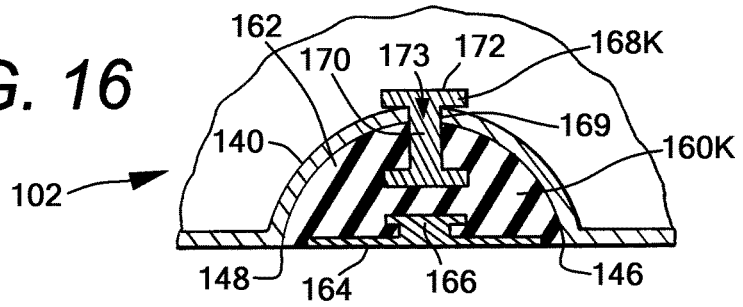
FIG. 16 is a magnified cross-section view of a portion of a twelfth illustrative embodiment of a head of a ball striking device according to the present invention.

FIG. 16 illustrates an example embodiment of a head 102 that includes a channel 140 as described above with respect to FIGS. 1-5A and an insert 160K mounted within the channel 140. Like the insert 160 in FIG. 5A, the insert 160K includes a base member 162 made of a resiliently deflectable material and an outer member 164 in the form of a rigid plate connected to the base member 162. In this embodiment, the base member 162 has a projection 168K received within a slot 169 to mount the insert 160K within the channel 140. However, in this embodiment, the projection 168K is formed as a separate piece that is connected to the base member by partially embedding a portion of the projection 168K within the base member 162, unlike the insert 160 in FIG. 5A. The projection 168K may be made wholly or partially from a resiliently deflectable material and includes stem 170 and an enlarged head 172 for insertion into the opening 173 of the slot 169. In one embodiment, the stem 170 may be made from a rigid material and may have a resiliently deformable head 172 connected thereto, which can deform during insertion through the opening 173. In another embodiment, the enlarged head 172 may be inserted within the slot 169 in another manner. It is understood that many other means and structure for connecting a separate projection 168K to the base member 162 are possible in other embodiments.

Figure 17:
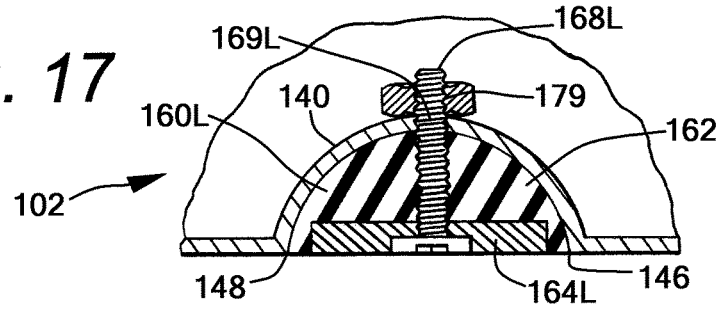
FIG. 17 is a magnified cross-section view of a portion of a thirteenth illustrative embodiment of a head of a ball striking device according to the present invention.

FIG. 17 illustrates an example embodiment of a head 102 that includes a channel 140 as described above with respect to FIGS. 1-5A and an insert 160L mounted within the channel 140. Like the insert 160 in FIG. 5A, the insert 160L includes a base member 162 made of a resiliently deflectable material and an outer member 164L in the form of a rigid plate connected to the base member 162. In this embodiment, a fastener 168L is used to connect the outer member 164 to the base member 162, and to connect the insert 160L to the body 108. The head 102 has a slot 169L that includes a threaded portion 179 for connection to the fastener 168L, which is also threaded. As shown in FIG. 17, the fastener 168L is inserted through the outer member 164L and through the center of the base member 162 and into the slot 169L, where the fastener 168L is threaded into the threaded portion 179. As shown in FIG. 17, the outer member 164L may be countersunk to accommodate an enlarged head of the fastener 168L. In one embodiment, the threaded portion 179 may be a nut that is connected to the inner surface of the body 108 to form a part of the slot 169L, such as by an integral joining technique. In other embodiments, other types of fasteners may be use, which rely on a variety of different fastening techniques, including interference fit, threading, swedging/swaging, expansion, etc.

Figure 18:
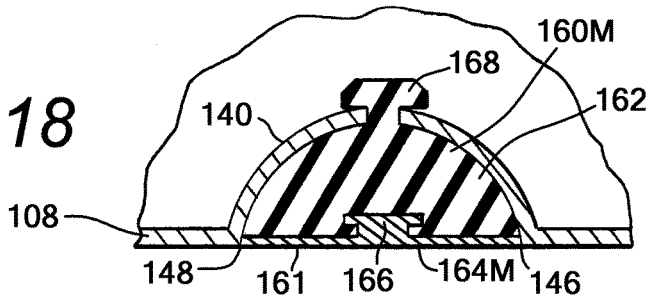
FIG. 18 is a magnified cross-section view of a portion of a fourteenth illustrative embodiment of a head of a ball striking device according to the present invention.

FIG. 18 illustrates an example embodiment of a head 102 that includes a channel 140 as described above with respect to FIGS. 1-5A and an insert 160M mounted within the channel 140, where the insert 160M includes a base member 162 and an outer member 164M partially embedded within the base member 162. As shown in FIG. 18, in this embodiment, the outer member 164M is connected to the base member 162 by a projection 166 that is embedded within the base member 162 in a complementary mating arrangement. Additionally, in this embodiment, the outer member 164M has a greater width than the outer member 164 in FIG. 5A. The outer member 164M has substantially the same width as the channel 140, such that no appreciable gaps are present between the sides 146, 148 of the channel 140 and the outer member 164M. Accordingly, the outer member 164M forms the entire outer surface 161 of the insert 160M, and the outer surface 161 of the insert 160M is substantially flat and substantially flush with the adjacent surfaces of the body 108 at the sides 146, 148 of the channel 140.

Still other embodiments of inserts can be incorporated into a head 102 of the present invention. Further, it is understood that one or more different features of the inserts 160, 160A-M described above with respect to FIGS. 1-18 can be combined into a single insert.

Heads 102 incorporating the compression channels 140 and inserts 160 disclosed herein may be used as a ball striking device or a part thereof. For example, a golf club 100 as shown in FIG. 1 may be manufactured by attaching a shaft or handle 104 to a head that is provided, such as the heads 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. Additionally, a set of golf clubs including one or more clubs 100 having heads 102 as described above may be provided. In other embodiments, different types of ball striking devices can be manufactured according to the principles described herein. Manufacturing the heads 102 shown and described herein may include attachment of a backbody member to a face frame member, as described above. Additionally, the head 102, golf club 100, or other ball striking device may be fitted or customized for a person, such as by attaching a shaft 104 thereto having a particular length, flexibility, etc., or by adjusting or interchanging an already attached shaft 104 as described above.

In some embodiments, the insert 160 may be removable from the channel 140 and/or interchangeable with another insert that has a similar connecting structure. Accordingly, customizing the head 102 may also include selecting an insert 160 for connection to the head 102 and/or interchanging an existing insert with another insert 160. Additionally, a kit may be provided that includes a head 102 as described above and a plurality of different inserts 160 configured for connection to the head 102. Inserts 160 can be selected for properties and characteristics including, for example, flexibility, size, weight, density, weight distribution, elasticity, hardness, strength, etc. These properties and characteristics can influence various properties of the head 102. Different inserts 160 may have different configurations as described herein, such as the different structural configurations in FIGS. 1-18. As another example, different inserts 160 may have different lengths, and can fill different portions of the channel 140. Further, different inserts 160 having similar or different structures may be made of different materials. For example, different inserts 160 may be made of heavier or lighter materials, and interchanging of inserts 160 may affect the weighting properties of the head 102, such as the total weight and/or weight distribution, including the center of gravity and/or moment of inertia. As another example, different inserts 160 may be made from materials having different degrees of strength, flexibility, resiliency, etc., and may alter the ability of the channel 140 to compress during impact and/or may exert different response forces on the face 112 during impact. Still other variations are possible, such as those described below.

Different inserts 160 having different flexibilities can influence the flexing properties of the channel 140, and also thereby influence the performance of the face 112, as mentioned above. Channels 140 having greater flexibility generally produce increased response (e.g. COR) in the face 112, and deeper channels typically have greater flexibility, all other factors being equal. However, without an insert 160 as described herein, channels 140 that are too deep and/or flexible risk failure, such as by cracking due to excessive flexing. The addition of an insert 160 can support the channel 140 and change its flexibility. A specific insert 160 having a desired flexibility and/or other characteristic(s) may be chosen to provide a desired performance by the channel 140 and/or the face 112, thereby "tuning" the channel 140 for a specific objective. For example, an insert 160 can be chosen based on its flexibility to achieve a flexibility of the channel 140 that increases the response of the face 112, such as to be as close as possible to the prevailing USGA limit for COR. As another example, an insert 160 can be chosen to customize the performance of the channel 140 and the face 112 to a particular user's swing characteristics. As some examples, a golfer with a slow swing speed may benefit from a softer or more flexible insert 160, and a golfer with a higher swing speed may benefit from a more hard or rigid insert 160. In one embodiment, the head 102 may include a relatively deep channel 140 with high flexibility, which may be deeper and more flexible than channels that were previously possible without failure, and an insert 160 can be selected to increase the flexibility of the channel 140 to a desired point, as described above, as well as providing resistance to cracking of the channel 140. In this embodiment, a wide range of flexibilities can be created by selecting an insert 160 with an appropriate flexibility. In one example, any insert 160 can be used in a set that ranges from a very flexible insert 160 that may provide the maximum flexibility possible without excessive risk of failure of the channel 140 to a very stiff insert 160 that greatly decreases the flexibility of the channel 140, providing a high degree of customizability.

The ball striking devices and heads therefor as described herein provide many benefits and advantages over existing products. For example, the flexing of the sole 118 at the channel 140 results in a smaller degree of deformation of the ball 106, which in turn can result in greater impact efficiency and greater energy and velocity transfer to the ball 106 during impact. As another example, the more gradual impact created by the flexing can create a longer impact time, which can also result in greater energy and velocity transfer to the ball 106 during impact. As a further example, the responsive or reactive force exerted on the face 112 as the compressed channel 140 and insert 160 expand to return to their initial shapes is imparted to the ball, which can result in greater energy and velocity transfer to the ball 106 during impact. As described above, inserts 160 having different flexibilities can be selected to "tune" the flexibility of the channel 140 and thereby "tune" performance of the face 112 to meet a specific objective, such as maximizing the response of the face 112 or customizing the face 112 to a particular user's swing characteristics, among other objectives. Still further, because the channel 140 extends toward the heel and toe edges 147, 149 of the face 112, the head 102 can achieve increased energy and velocity transfer to the ball 106 for impacts that are away from the center or traditional "sweet spot" of the face 112. As yet another example, the substantially smooth keel 156 and the surface 161 of the insert 160 can decrease drag and other forces on the sole 118 during contact with the playing surface, which can increase distance and accuracy. As an additional example, the features described herein may result in improved feel of the golf club 100 for the golfer, when striking the ball 106. Further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face having a ball striking surface configured for striking a ball;

a body connected to the face and extending rearwardly from the face, the body and the face defining an enclosed internal cavity, wherein the body comprises a crown, a sole, a heel, and a toe;

an elongated, inwardly recessed channel located on the sole and extending across a portion of the sole in a heel-to-toe direction, the channel having a front edge located adjacent a peripheral edge of the face and a rear edge located rearwardly of the front edge, and the channel comprising a trough that is inwardly recessed with respect to adjacent surfaces of the body and sidewalls extending inwardly from the front and rear edges to the trough, wherein the body has a thin-wall construction, such that the channel creates a raised portion on an interior surface of the body; and a slot positioned within the channel and extending completely through a wall of the channel, such that the slot is in communication with the internal cavity and with an exterior of the body, wherein the sidewalls extend into the internal cavity to create the raised portion on the interior surface of the body.

2. The golf club head of claim 1, further comprising:

an insert mounted within the channel and engaging the channel to retain the insert within the channel, wherein the insert completely covers the slot.

3. The golf club head of claim 2, wherein a portion of the insert is received within the slot.

4. The golf club head of claim 3, wherein the portion of the insert received within the slot is exposed to an interior of the body.

5. The golf club head of claim 3, wherein the portion of the insert is received within the slot and fills the slot.

6. The golf club head of claim 2, wherein the insert is formed of a resilient polymer material.

7. The golf club head of claim 2, wherein the insert completely fills at least a portion of a length of the channel.

8. The golf club head of claim 1, wherein the slot has a length measured in the heel-to-toe direction and a width measured in a direction extending between front and rear edges of the channel, and wherein at least one of the length and the width of the slot are smaller than a respective length or width of the channel.

9. The golf club head of claim 1, wherein the channel extends adjacent and substantially parallel to the face.

10. The golf club head of claim 1, wherein the slot is positioned within the trough of the channel.

11. A golf club head comprising:

a face having a ball striking surface configured for striking a ball;

a body connected to the face and extending rearwardly from the face, the body and the face defining an enclosed internal cavity;

an elongated, inwardly recessed channel located on the body and extending across a portion of the body, the channel having a front edge located adjacent a peripheral edge of the face and extending substantially parallel to the peripheral edge of the face and a rear edge located rearwardly of the front edge, the channel comprising a trough that is inwardly recessed with respect to adjacent surfaces of the body and sidewalls extending inwardly from the front and rear edges to the trough, wherein the body has a thin-wall construction, such that the channel creates a raised portion on an interior surface of the body; and a slot positioned within the channel, the slot comprising an opening and extending completely through a wall of the channel, such that the slot is in communication with the internal cavity and with an exterior of the body, wherein the sidewalls extend into the internal cavity to create the raised portion on the interior surface of the body.

12. The golf club head of claim 11, further comprising:

an insert mounted within the channel and engaging the channel to retain the insert within the channel, wherein the insert completely covers the slot.

13. The golf club head of claim 12, wherein a portion of the insert is received within the slot.

14. The golf club head of claim 13, wherein the portion of the insert received within the slot is exposed to an interior of the body.

15. The golf club head of claim 13, wherein the portion of the insert is received within the slot and fills the slot.

16. The golf club head of claim 12, wherein the insert is formed of a resilient polymer material.

17. The golf club head of claim 12, wherein the insert completely fills at least a portion of a length of the channel.

18. The golf club head of claim 11, wherein the slot has a length measured in a heel-to-toe direction and a width measured in a direction extending between the front and rear edges of the channel, and wherein at least one of the length and the width of the slot are smaller than a respective length or width of the channel.

19. The golf club head of claim 11, wherein the slot is positioned within the trough of the channel.

20. A golf club head comprising:

a face having a ball striking surface configured for striking a ball;

a body connected to the face and extending rearwardly from the face, the body and the face defining an enclosed internal cavity, wherein the body comprises a crown, a sole, a heel, and a toe;

an elongated, inwardly recessed channel located on the body and extending across a portion of the body in a heel-to-toe direction, the channel having a front edge located adjacent a peripheral edge of the face and a rear edge located rearwardly of the front edge, and the channel comprising a trough that is inwardly recessed with respect to adjacent surfaces of the body and sidewalls extending inwardly from the front and rear edges to the trough, wherein the body has a thin-wall construction, such that the channel creates a raised portion on an interior surface of the body;

a slot positioned within the channel and extending completely through a wall of the channel, such that the slot is in communication with the internal cavity and with an exterior of the body; and a flexible polymer material at least partially filling the channel and engaging the channel, wherein the polymer material completely covers the slot, and a portion of the polymer material extends into the slot and is received within the slot, wherein the sidewalls extend into the internal cavity to create the raised portion on the interior surface of the body.

21. The golf club head of claim 20, wherein the polymer material completely fills at least a portion of a length of the channel.

22. The golf club head of claim 20, wherein the slot is positioned within the trough of the channel.

23. The golf club head of claim 20, wherein the channel extends adjacent and substantially parallel to the face.

24. The golf club head of claim 20, wherein the slot has a length measured in the heel-to-toe direction and a width measured in a direction extending between front and rear edges of the channel, and wherein at least one of the length and the width of the slot are smaller than a respective length or width of the channel.

25. The golf club head of claim 24, wherein the portion of the polymer material extending into the slot has at least one of a length and a width that are smaller than a respective length or width of the polymer material.

26. The golf club head of claim 20, wherein the portion of the polymer material extending into the slot is exposed to an interior of the body.

27. The golf club head of claim 20, wherein the portion of the polymer material is received within the slot and fills the slot.

* * * * *